US008695238B2

(12) United States Patent
Warchola et al.

(10) Patent No.: US 8,695,238 B2
(45) Date of Patent: Apr. 15, 2014

(54) SNOWPLOW WITH AUTO ANGLING AND WIRELESS CONTROLLER

(75) Inventors: Marty Warchola, Medina, OH (US); Jim Ropog, North Olmsted, OH (US)

(73) Assignee: Meyer Products, LLC, Cleveland, OH (US)

( * ) Notice: Subject to any disclaimer, the term of this patent is extended or adjusted under 35 U.S.C. 154(b) by 368 days.

(21) Appl. No.: 13/251,795

(22) Filed: Oct. 3, 2011

(65) Prior Publication Data

US 2012/0180345 A1 Jul. 19, 2012

Related U.S. Application Data

(63) Continuation-in-part of application No. 13/008,542, filed on Jan. 18, 2011, now Pat. No. 8,453,358.

(51) Int. Cl.
*E01H 5/04* (2006.01)

(52) U.S. Cl.
USPC ..... 37/234

(58) Field of Classification Search
USPC ..... 37/219–236, 272, 414–417; 172/2–11, 172/810–818; 701/50
See application file for complete search history.

(56) References Cited

U.S. PATENT DOCUMENTS

| | | | | |
|---|---|---|---|---|
| 4,073,077 | A | 2/1978 | Essel et al. | |
| 4,074,448 | A | 2/1978 | Niemela | |
| 4,635,387 | A | 1/1987 | Haring | |
| 4,999,935 | A * | 3/1991 | Simi et al. | 37/236 |
| 5,174,385 | A * | 12/1992 | Shinbo et al. | 172/4.5 |
| 5,485,690 | A | 1/1996 | MacQueen | |
| 5,524,368 | A * | 6/1996 | Struck et al. | 37/235 |
| 5,909,960 | A * | 6/1999 | Jager et al. | 37/235 |
| 6,163,985 | A * | 12/2000 | Chinnery et al. | 37/234 |
| 6,526,677 | B1 | 3/2003 | Bloxdorf et al. | |
| 6,691,435 | B1 * | 2/2004 | Schultz et al. | 37/234 |
| RE38,665 | E | 12/2004 | Struck et al. | |
| 6,983,558 | B2 | 1/2006 | Haas | |
| 7,028,423 | B1 | 4/2006 | Curry | |

FOREIGN PATENT DOCUMENTS

| | | |
|---|---|---|
| JP | 63-095726 | 6/1988 |
| JP | 04-309609 | 11/1992 |
| KR | 10-0408486 | 12/2003 |
| KR | 10-0465479 | 1/2005 |

OTHER PUBLICATIONS

PCT—Notification of Transmittal International Preliminary Report and The Written Opinion of the International Searching Authority, Oct. 4, 2011. [From corresponding U.S. Appl. No. 13/008,542, filed Jan. 18, 2011].

PCT—International Search Report, Oct. 4, 2011. [From corresponding U.S. Appl. No. 13/008,542, filed Jan. 18, 2011].

PCT—International Written Opinion, Oct. 4, 2011. [From corresponding U.S. Appl. No. 13/008,542, filed Jan. 18, 2011].

* cited by examiner

*Primary Examiner* — Robert Pezzuto

(74) *Attorney, Agent, or Firm* — Roger D. Emerson; Timothy D. Bennett; Emerson Thomson Bennett

(57) ABSTRACT

A snowplow assembly may combine a wireless control system used to raise and lower a plow blade with a mechanism that automatically pivots the plow blade from side to side based on the load encountered by the plow blade.

20 Claims, 24 Drawing Sheets

SNOWPLOW WITH AUTO ANGLING AND WIRELESS CONTROLLER

This application is a CIP patent application claiming priority from U.S. Ser. No. 13/008,542, filed Jan. 18, 2011 now U.S. Pat. No. 8,453,358, entitled DUAL COMPRESSION SPRING RAM, which is herein incorporated by reference.

I. BACKGROUND

A. Field of Invention

This invention relates generally to snowplows and more specifically to cylinders and rams for snowplows and the manner in which they are controlled.

B. Description of the Related Art

It is well known in the art to provide a snowplow on the front of a vehicle for displacing snow, sleet, ice and the like along a roadway, driveway, or other ground surface. Generally, a snowplow assembly will include a plow blade that is used to contact the snow and a mount assembly that is used to mount the snowplow mechanism to the vehicle. Many snowplow assemblies pivotally attach the plow blade to the mount assembly allowing the blade to pivot about a vertical pivot axis and direct plowed snow to either side of the vehicle path. The snowplow assembly may include one or more pneumatic or hydraulic cylinders to pivot the plow blade about the vertical pivot axis and direct the plowed snow. Often, these cylinders can be controlled from inside the vehicle during plowing. The mount assemblies are often pivotally attached to a vehicle for selectively raising and lowering the snowplow assembly using hydraulic controls located in the vehicle. The plow blade may also be pivotally attached to the mount assembly allowing the plow blade (or a portion of the blade) to pivot about a horizontal mounting axis. Springs, or trip springs, may connect between the plow blade and the mount assembly for biasing the plow blade in an upright position and for dampening the rotational movement about the horizontal mounting axis when the plow blade encounters an obstacle. This mechanism is often referred to as a trip or trip spring assembly.

While known plow blades generally work well for their intended purpose, they have disadvantages. One disadvantage is that known pneumatic and hydraulic cylinders can be heavy, which adds additional unwanted weight to a snowplow assembly. Therefore, what is needed is a snowplow assembly that resolves one or more of disadvantages in the prior art.

It is also know to use a wireless control system with a snowplow assembly. It is not known, however, to combine a wireless control system used to raise and lower a plow blade with a mechanism that automatically pivots the plow blade from side to side based on the load encountered by the plow blade.

II. SUMMARY

According to one embodiment of this invention, a snowplow assembly may comprise: a plow blade assembly including a plow blade with a snow engaging surface for plowing snow; a first plow blade positioning cylinder that operates to pivot the plow blade from side to side, the first plow blade positioning cylinder comprising a first resilient member that automatically pivots the plow blade from side to side without use of a power source; a second plow blade positioning cylinder that operates to raise and lower the plow blade between a lowered plowing positioned and a raised non-plowing position; a power source operatively connected to the second plow blade positioning cylinder; and, a control system. The control system may comprise: a controller comprising an operating mechanism; a transmitter; and, a receiver that is operatively connected to the power source. The operating mechanism may be operable to cause the transmitter to transmit a wireless control signal that is received by the receiver and, in response, the receiver causes the power source to operate the second plow blade positioning cylinder to move the plow blade between the lowered plowing positioned and the raised non-plowing position.

According to another embodiment of this invention, a snowplow assembly may comprise: a mount assembly operatively connected to an associated vehicle; a plow blade assembly including a plow blade with a snow engaging surface for plowing snow, wherein the plow blade assembly is pivotally connected to the mount assembly; a first plow blade positioning cylinder that operates to pivot the plow blade from side to side, the first plow blade positioning cylinder comprising a cylinder housing, a piston, a piston rod, and first and second resilient members located substantially within the cylinder housing, wherein a first end of the first plow blade positioning cylinder is pivotally connected to the mount assembly and a second end of the first plow blade positioning cylinder is pivotally connected to the plow blade assembly, wherein the first and second resilient members automatically pivot the plow blade from side to side without use of a power source; a second plow blade positioning cylinder that operates to raise and lower the plow blade between a lowered plowing positioned and a raised non-plowing position; a power source operatively connected to the second plow blade positioning cylinder; and, a control system. The control system may comprise: a controller comprising an operating mechanism; a transmitter; and, a receiver that is operatively connected to the power source. The operating mechanism may be operable to cause the transmitter to transmit a wireless control signal that is received by the receiver and, in response, the receiver causes the power source to operate the second plow blade positioning cylinder to move the plow blade between the lowered plowing positioned and the raised non-plowing position.

According to yet another embodiment of this invention, a method may comprise the steps of: (A) providing a snowplow assembly comprising: a plow blade assembly including a plow blade with a snow engaging surface for plowing snow; a first plow blade positioning cylinder that operates to pivot the plow blade from side to side, the first plow blade positioning cylinder comprising a first resilient member; a second plow blade positioning cylinder that operates to raise and lower the plow blade between a lowered plowing positioned and a raised non-plowing position; and, a power source operatively connected to the second plow blade positioning cylinder; (B) providing a control system comprising: a controller comprising an operating mechanism; a transmitter; and, a receiver that is operatively connected to the power source; (C) using the first resilient member to automatically pivot the plow blade from side to side without use of any power source; and, (D) operating the operating mechanism to cause the transmitter to transmit a wireless control signal that is received by the receiver and, in response, the receiver causes the power source to operate the second plow blade positioning cylinder to move the plow blade between the lowered plowing positioned and the raised non-plowing position.

Numerous benefits and advantages of the invention will become apparent to those skilled in the art to which it pertains upon a reading and understanding of the following detailed specification.

Other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION OF THE INVENTION

Figure 1:
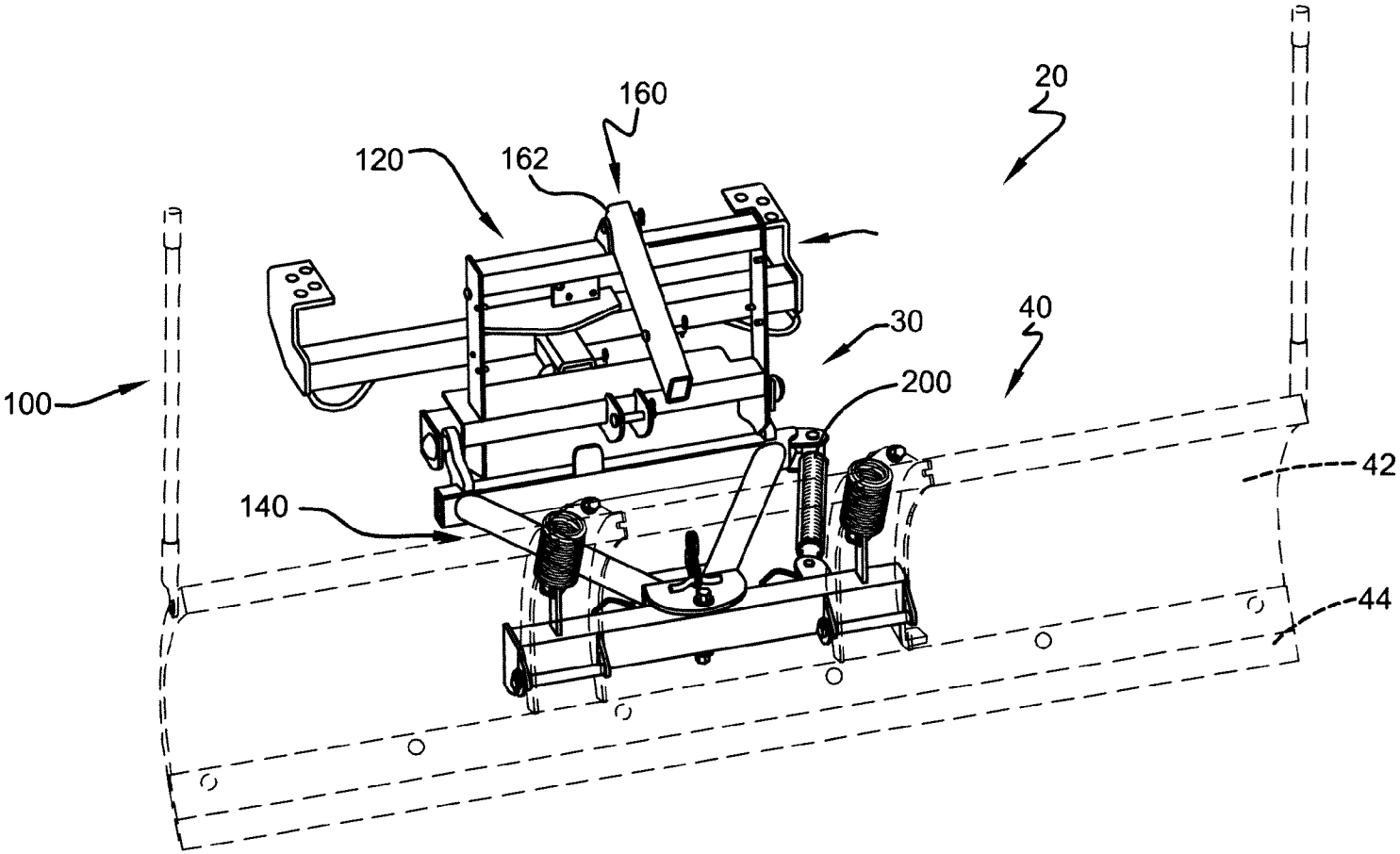
FIG. 1 is a perspective view of a snowplow assembly, according to one embodiment.

Referring now to the drawings wherein the showings are for purposes of illustrating embodiments of the invention only and not for purposes of limiting the same, and wherein like reference numerals are understood to refer to like components, FIG. 1 shows a snowplow assembly 20 including a mount assembly 30 and a plow blade assembly 40, according to one embodiment of this invention. With reference to all the FIGURES, the mount assembly 30 can include a frame mount assembly 100, which is secured to the frame members of a vehicle (not shown), a support assembly 120 secured to the frame mount assembly 100, a plow mount assembly 140 secured to the support assembly, and a lift mount assembly 160 which is also secured to the support assembly 120. The lift mount assembly 160 can include a lift bar 162 and an actuator (not shown) for raising and lowering the plow mount assembly 140 and the plow blade assembly 40. The plow blade assembly 40 includes an inwardly curved moldboard or plow blade 42 and a scraper blade 44 attached to the bottom of plow blade 40. The plow mount assembly 140 can include a general A-frame shape with an apex 142 of the A-frame pivotally connected to the plow blade assembly 40 and a base 144 of the A-frame pivotally connected to the support assembly 120. The apex 142 can include a C-shaped or U-shaped bracket 150 used to pivotally connect the plow mount assembly 140 or A-frame to the plow blade assembly 40. The plow blade assembly 40 can include one or more trip springs 46 connected between the plow blade 42 and a mount bar 48.

Figure 2:
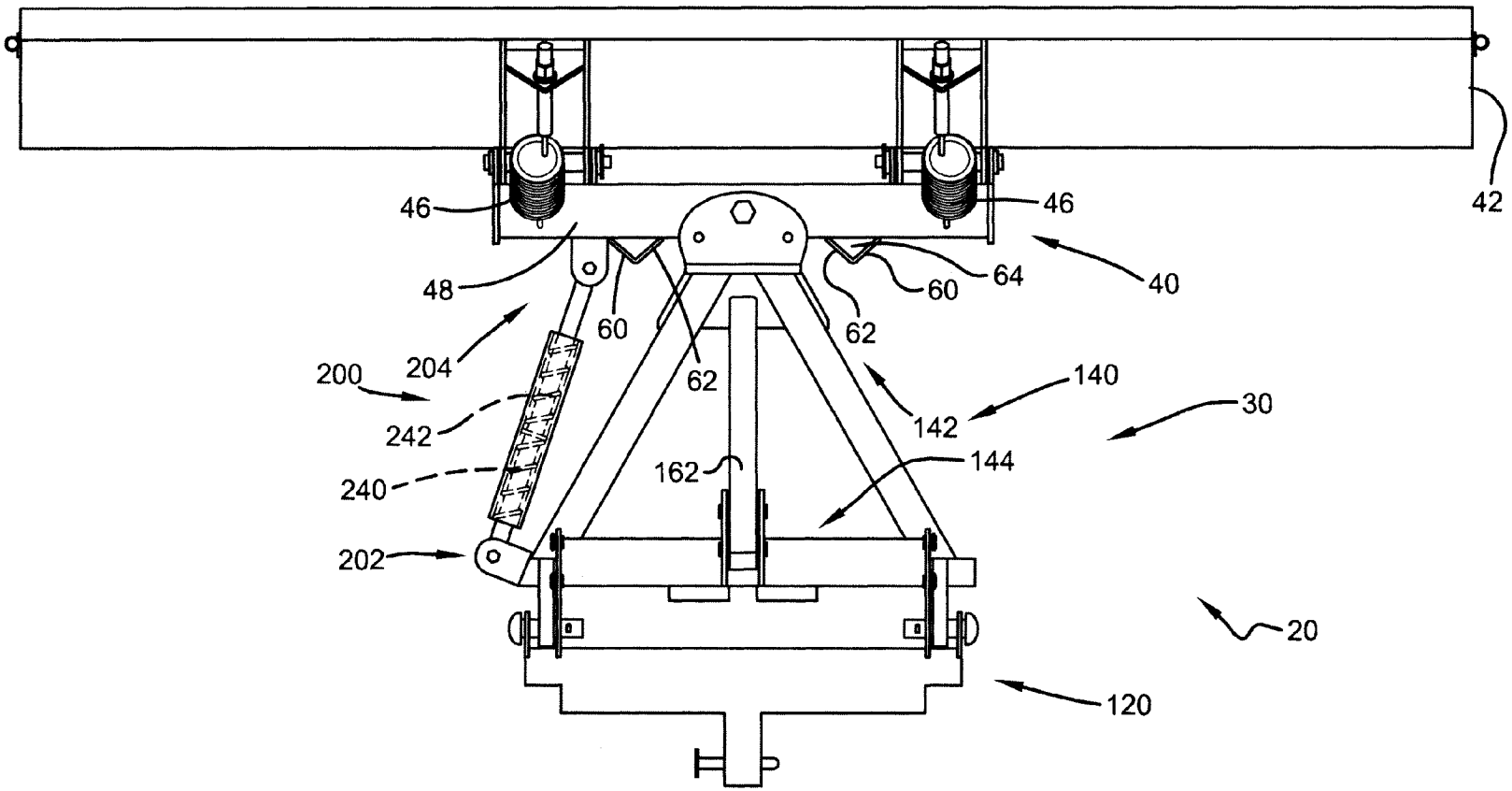
FIG. 2 is a top view of a snowplow assembly illustrating the internal components of a cylinder when the snowplow is in a straight position, according to one embodiment.
Figure 3:
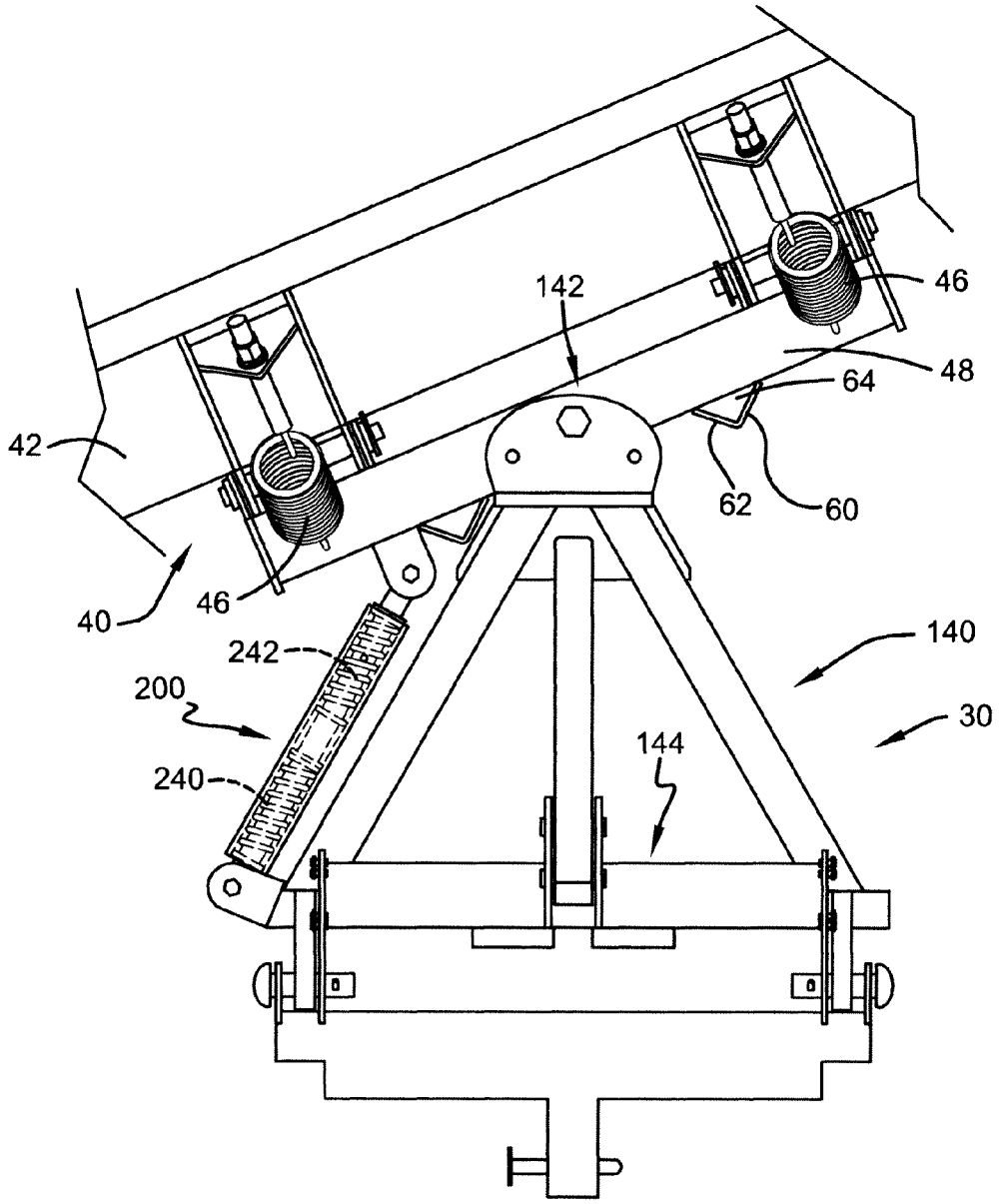
FIG. 3 is a top view of a snowplow assembly illustrating the internal components of a cylinder when the snowplow is in a first angled position, according to one embodiment.
Figure 4:
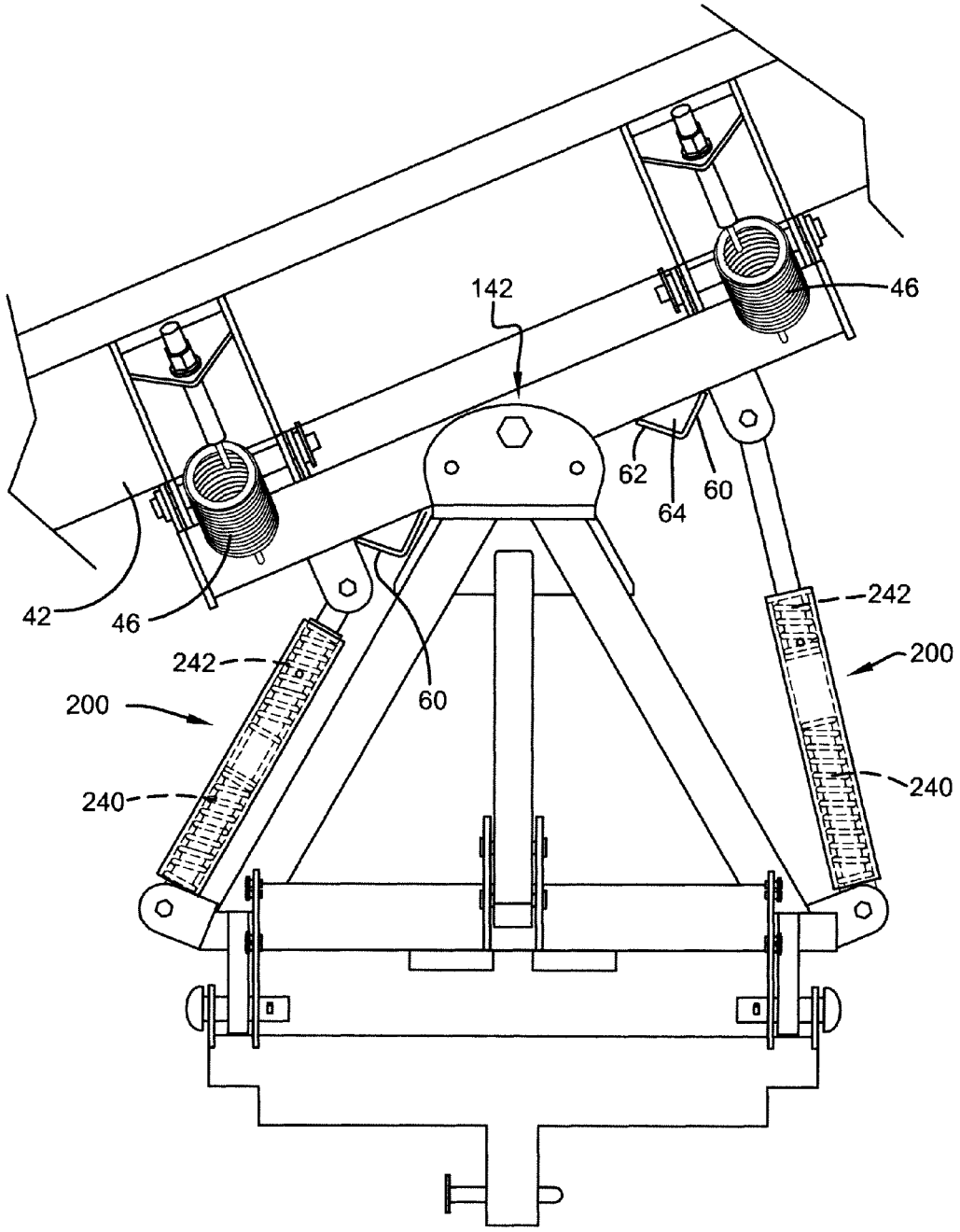
FIG. 4 is a top view of a snowplow assembly illustrating the internal components of two cylinders when the snowplow is in a first angled position, according to one embodiment.

With reference to FIGS. 2-8, the snowplow assembly 20 can include a cylinder 200 with one end 204 pivotally connected to the plow blade assembly 40 and the other end 202 pivotally connected to the plow mount assembly 140 of the mount assembly 40. The cylinder 200 can include a cylinder housing 210, a piston 220, a piston rod 230, and a resilient member 240, as shown in FIGS. 8A and 8B. In some embodiments, the cylinder 200 can include one resilient member 240, and in other embodiments, the cylinder 200 can include two resilient members 240. According to other embodiments, the cylinder 200 can include more than two resilient members 240. When the cylinder 200 includes multiple resilient members 240, the resilient members 240 can be different from each other or they can be substantially identical to each other. In some embodiments, the resilient members 240 are springs, which can operate in compression, in tension, or in both. Any type of spring can be chosen by a person of ordinary skill in the art. The piston 220 is sized to slide within the cylinder housing 210 and to engage the resilient members 240. The piston 220 can be a protruding rim or flange located near one end of the piston rod 230. The piston 220, the piston rod 230, or both can compress or extend the resilient members 240. In some embodiments, the snowplow assembly 20 can include a second cylinder 200 located on the opposite side of the plow mount assembly 140 from the first cylinder 200, as shown in FIG. 4.

According to some embodiments, the snowplow assembly 20 includes one cylinder 200 having two springs 240, 242. The springs 240, 242 can be positioned within the cylinder housing 210 with one resilient member 240 located on one side of the piston 220 and the second resilient member 242 on the opposite side of the piston 220. When the cylinder 200 is in a neutral position, as shown in FIG. 2, both springs 240, 242 can be in an equilibrium condition, in which the springs 240, 242 are exerting substantially no force on the piston 220, also called a relaxed condition, or the springs 240, 242 are exerting substantially equal or balanced forces on the piston 220. The cylinder 200 can maintain the plow blade assembly 40 in a straight or neutral orientation or position until an offset force acts on the plow blade assembly 40 to overcome the force of one or both of the resilient members 240, 242. When the cylinder 200 is in a retracted or extended position, the springs 240, 242 exert unequal forces on the piston 220.

Figure 5:
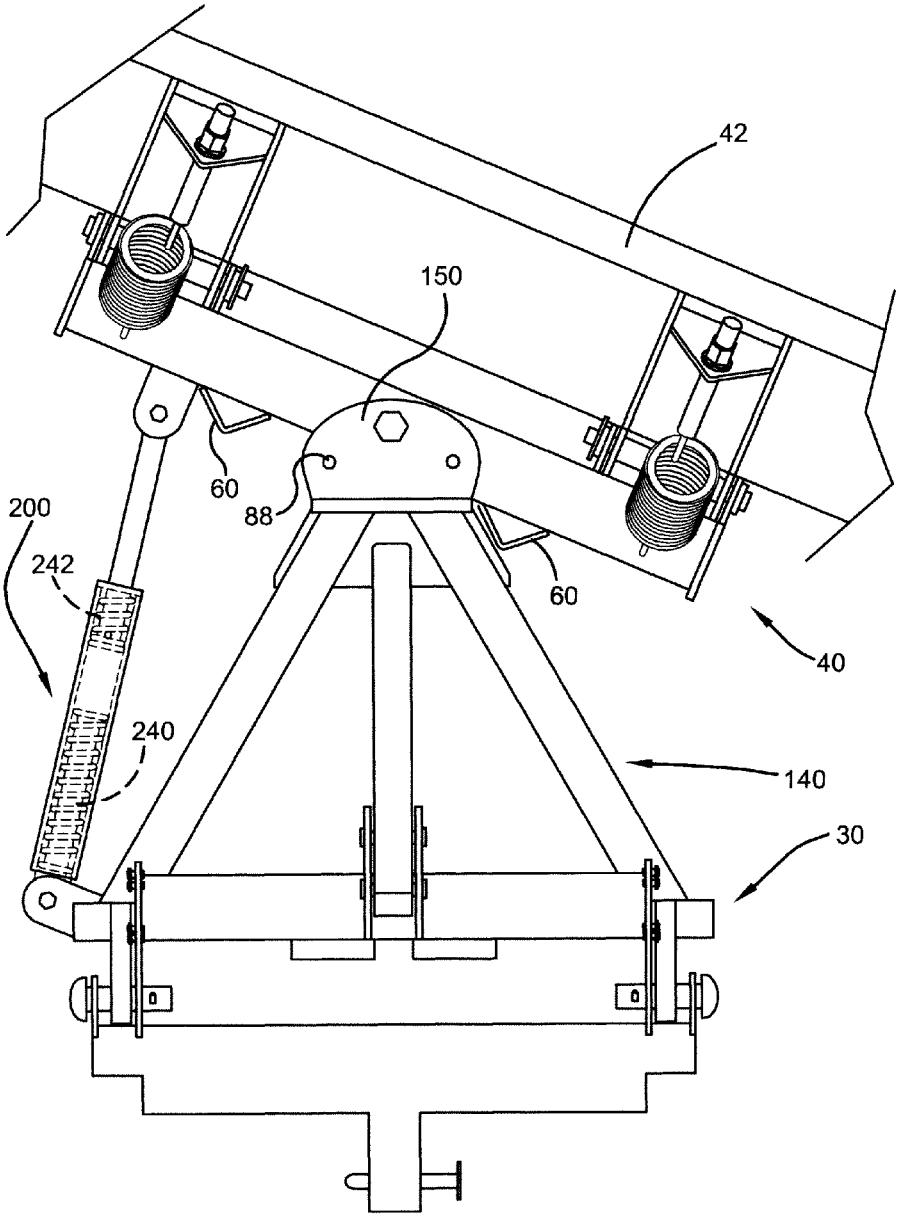
FIG. 5 is a top view of a snowplow assembly illustrating the internal components of a cylinder when the snowplow is in a second angled position, according to one embodiment.
Figure 6A:
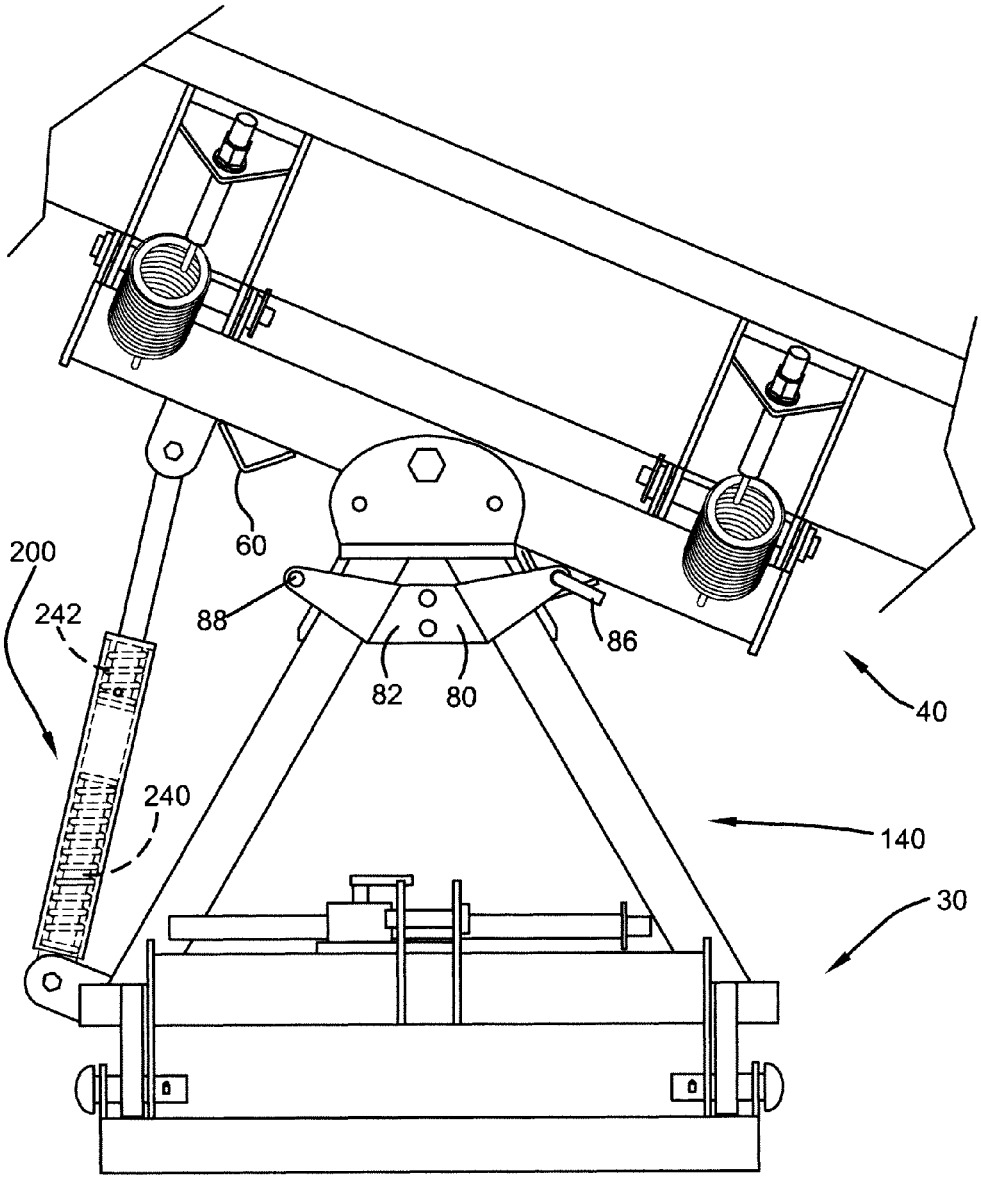
FIG. 6A is a top view of a snowplow assembly illustrating the internal components of a cylinder when the snowplow is in a second angled position, according to one embodiment.
Figure 6B:
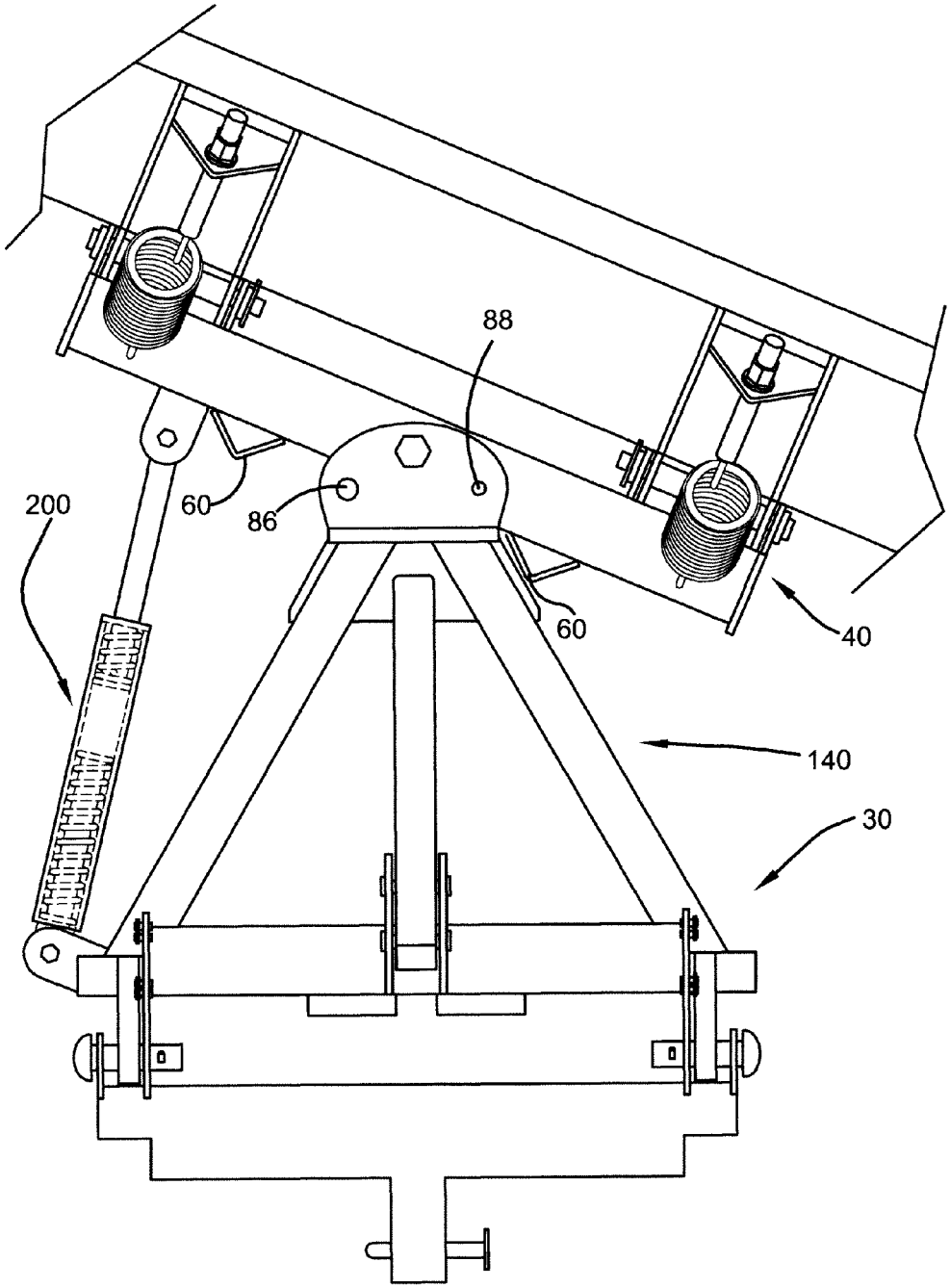
FIG. 6B is a top view of a snowplow assembly illustrating the internal components of a cylinder when the snowplow is in a second angled position, according to one embodiment.

In some embodiments, the springs 240, 242 can operate in compression to exert a force on the piston 220. When the cylinder 200 is in a retracted position, as shown in FIGS. 3 and 4, the first resilient member 240 compresses which exerts a force on the piston 220 in a first direction, and the second resilient member 242 at least partially relaxes or remains in a relaxed condition. When the cylinder 200 is in an extended position, as shown in FIGS. 5-7, the second resilient member 242 compresses which exerts a force on the piston 220 in a second direction, and the first spring 240 at least partially relaxes or remains in a relaxed condition. The first and second directions can be in substantially opposite directions.

In other embodiments, the springs 240, 242 can operate in tension to exert a force on the piston 220. When the cylinder 200 is in a retracted position, the second spring 242 extends which exerts a force on the piston 220 in a first direction, and the first spring 240 at least partially relaxes or remains in a relaxed condition. When the cylinder 200 is in an extended position, the first spring 240 extends which exerts a force on the piston 220 in a second direction, and the second spring 242 at least partially relaxes or remains in a relaxed condition.

In still other embodiments, the springs 240, 242 can operate in both compression and tension to exert a force on the piston 220. When the cylinder 200 is in a retracted position, the first resilient member 240 compresses which exerts a force on the piston 220 in a first direction, and the second spring 242 extends which also exerts a force on the piston 220 in the first direction. When the cylinder 200 is in an extended position, the second resilient member 242 compresses which exerts a force on the piston 220 in a second direction, and the first spring 240 extends which also exerts a force on the piston 220 in the second direction.

According to some embodiments, the snowplow assembly 20 includes one cylinder 200 having one spring 240. The spring 240 can be positioned within the cylinder housing 210 and can be located on either side of the piston 220. When the cylinder 200 is in a neutral position, as shown in FIG. 2, the spring 240 can be in an equilibrium condition where the springs are exerting substantially no force on the piston 220 or where the springs 240, 242 are exerting substantially equal forces on the piston 220. When the cylinder 200 is in a retracted or extended position, the spring 240 can exert a force on the piston 220 in either compression or tension. In some embodiments, when the cylinder 200 is in a retracted position, the spring 240 compresses exerting a force on the piston 220 in a first direction, and when the cylinder 200 is in an extended position, the spring 240 extends exerting a force on the piston 220 in a second direction. In other embodiments, when the cylinder 200 is in a retracted position, the spring 240 extends exerting a force on the piston 220 in a first direction, and when the cylinder 200 is in an extended position, the spring 240 compresses exerting a force on the piston 220 in a second direction.

In some embodiments, the cylinder 200 is in a retracted position when the snowplow assembly 20 is in the first angled position, and the cylinder 200 is in an extended position when the snowplow assembly 20 is in the second angled position. In other embodiments, the cylinder 200 is in an extended position when the snowplow assembly 20 is in the first angled position, and the cylinder 200 is in a retracted position when the snowplow assembly 20 is in the second angled position.

The snowplow assembly 20 can include a stop device 60, which can limit the travel of the plow blade assembly 40 in an angled position. The stop device 60 can limit the travel of the plow blade assembly 40 in a first angled position shown in FIGS. 3 and 4, or in a second angled position shown in FIGS. 5-7. The plow mount assembly 140 makes contact with the stop device 60 in the first or second angled position. The stop device 60 provides a surface 62 to contact the plow mount assembly 140. In some embodiments, the stop device 60 a stop plate or angle bracket. The stop plate 60 can be positioned on the mount bar 48 to create an opening 64 between the stop plate 60 and the mount bar 48. In some embodiments, the snowplow assembly 20 includes two stop devices 60, 60 with one located on either side of the plow mount assembly 140.

Figure 7A:
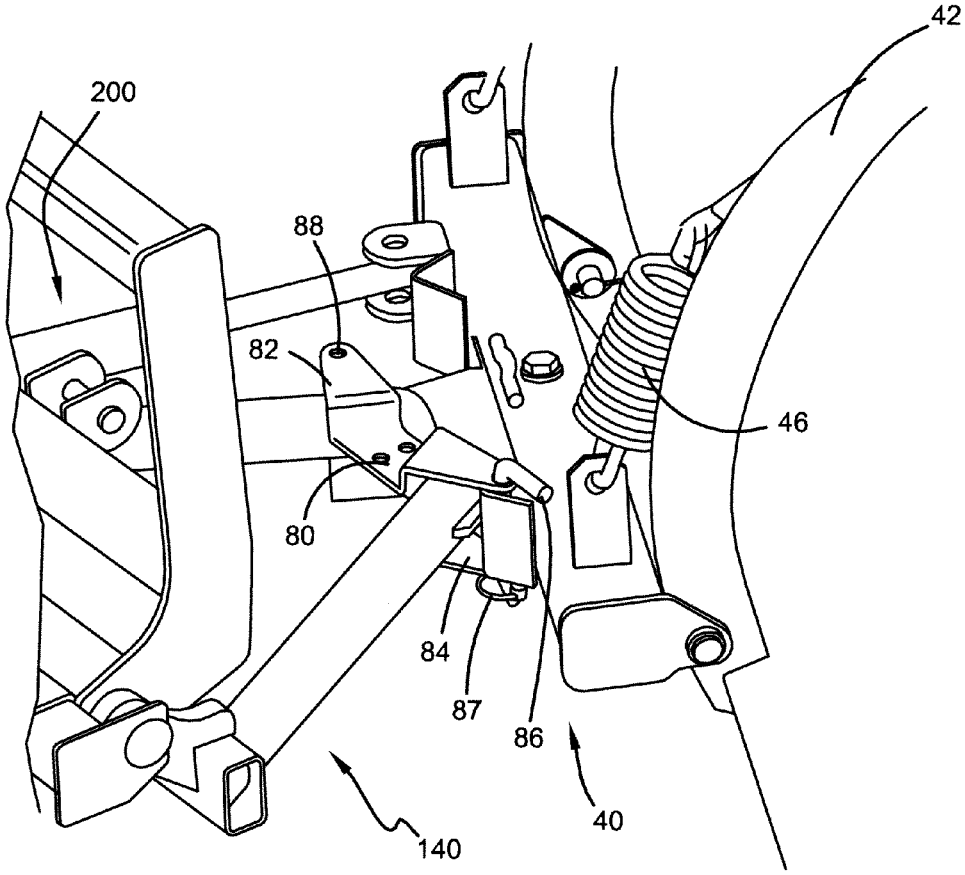
FIG. 7A is a side perspective view of a snowplow assembly illustrating the locking device when the snowplow is in a second angled position, according to one embodiment.

The snowplow assembly 20 can include a locking device 80, which can maintain the plow blade assembly 40 in an angled position. The locking device 80 can maintain the plow blade assembly 40 in a first angled position shown in FIGS. 3 and 4, or in a second angled position shown in FIGS. 5-7. According to some embodiments, the locking device 80 can include a top bracket 82, a bottom bracket 84, and a retaining device 86. The top and bottom brackets 82, 84 can each include an aperture 88, which receives the retaining device 86. The retaining device 86 can be a pin, bolt, or any other fastener with a head 90. When the plow blade assembly 40 is in either the first or second angled position, the apertures 88 in the top and bottom brackets 82, 84 of the locking device 80 align with the opening 64 in the stop plate 60. The retaining device 86 can then pass through the aperture 88 in the top bracket 82, the opening 64 between the stop plate 60 and the mount bar 48, and the aperture 88 in the bottom bracket 84, as shown in FIG. 7A. In addition, a cotter pin or locking pin 87 can be inserted into an opening in the retaining device 86 to maintain the retaining device within the apertures 88, 88 and opening 64. This secures the plow blade assembly 40 to the plow mount assembly 140 in the first or second angled position. In some embodiments, the snowplow assembly 20 includes two locking devices 80, 80 with one located on either side of the plow mount assembly 140.

Figure 7B:
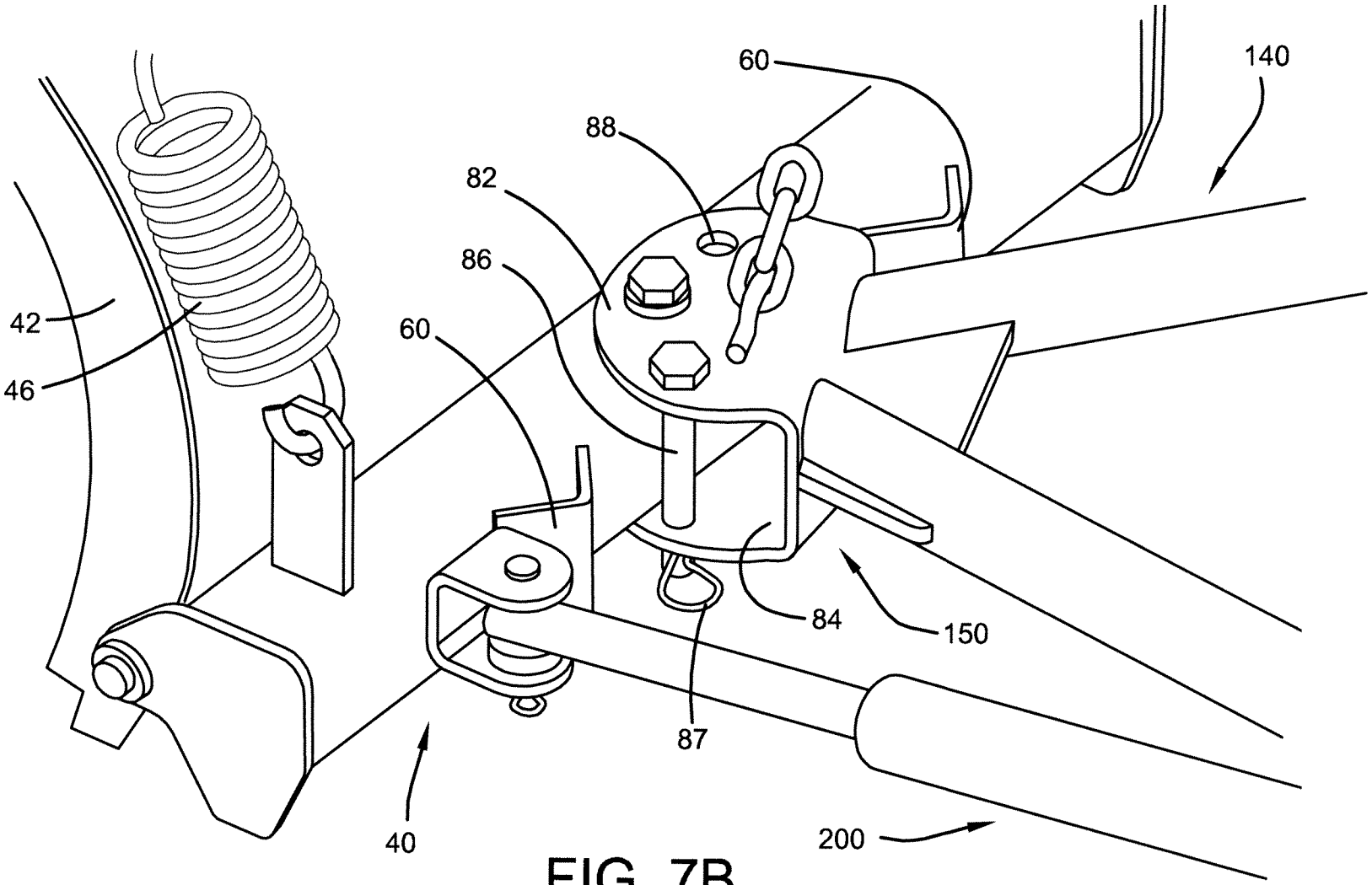
FIG. 7B is a side perspective view of a snowplow assembly illustrating the locking device when the snowplow is in a second angled position, according to one embodiment.
Figure 8B:
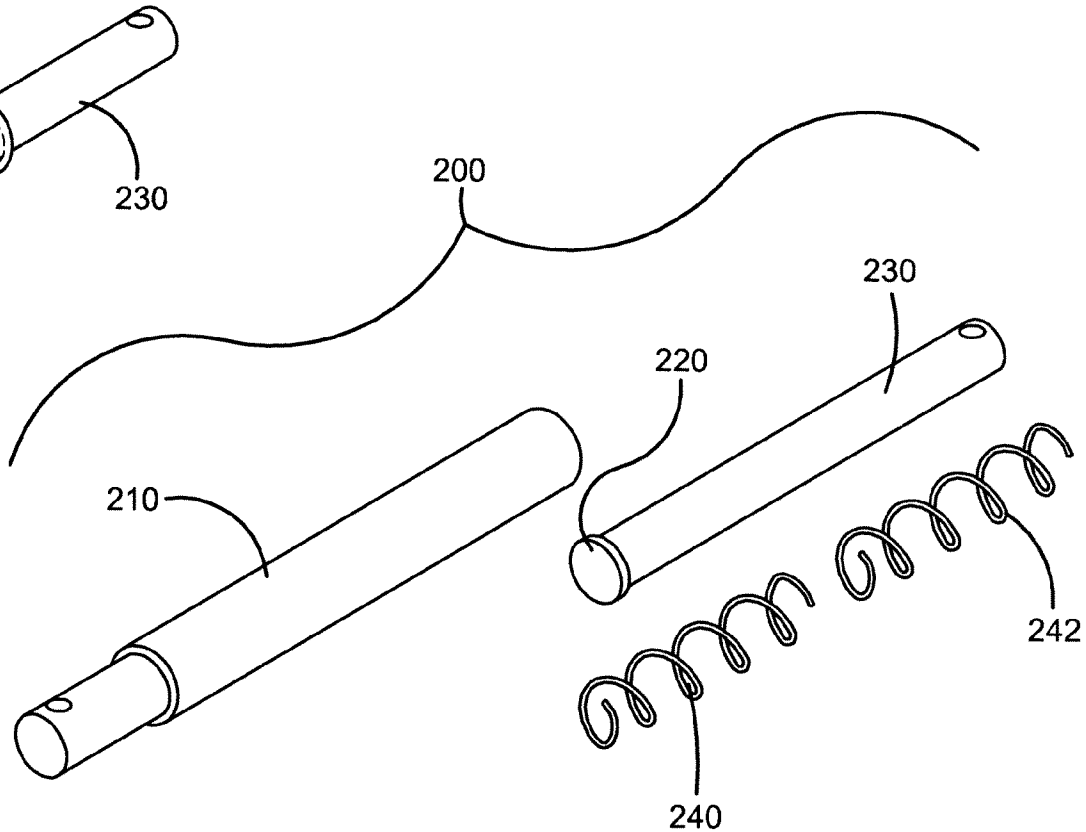
FIG. 8B is a perspective view of a disassembled cylinder illustrating the components of the cylinder, according to one embodiment.
Figure 8A:
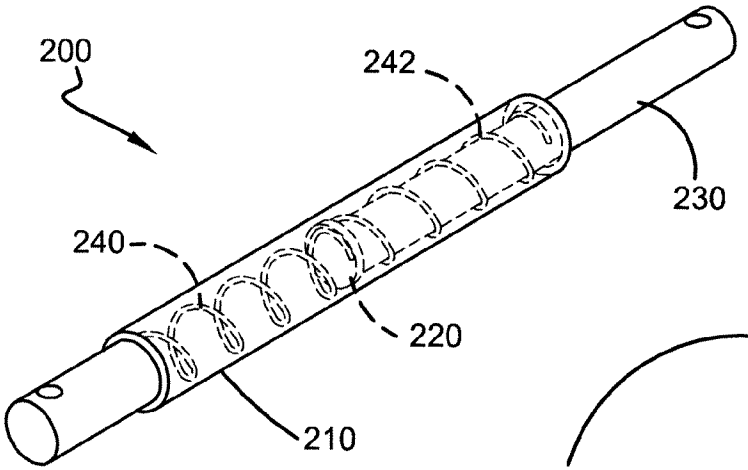
FIG. 8A is a perspective view of an assembled cylinder illustrating the internal components of the cylinder, according to one embodiment.

According to other embodiments, the locking device 80 can include a bracket 150 and a retaining device 86. The top and bottom portions 82, 84 of the bracket 150 can each include an aperture 88, which receives the retaining device 86. The retaining device 86 can be any fastener chosen by a person of ordinary skill in the art. When the plow blade assembly 40 is in either the first or second angled position, the retaining device 86 can be inserted into the aperture 88 in the top portion 82 and the aperture 88 in the bottom portion 84, as shown in FIG. 7B. The retaining device 86 contacts the mount bar 48, which maintains the plow blade assembly 40 in either the first or second angled position. In an alternate embodiment, when the plow blade assembly 40 is in either the first or second angled position, the apertures 88 in the top and bottom portions 82, 84 of the bracket 150 can align with an opening in the mount bar 48. The retaining device 86 can then pass through the apertures 88, 88 in the bracket 150 and the opening in the mount bar 48. A cotter pin or locking pin 87 can be inserted into an opening in the retaining device 86 to maintain the retaining device within the apertures 88, 88.

Figure 9A:
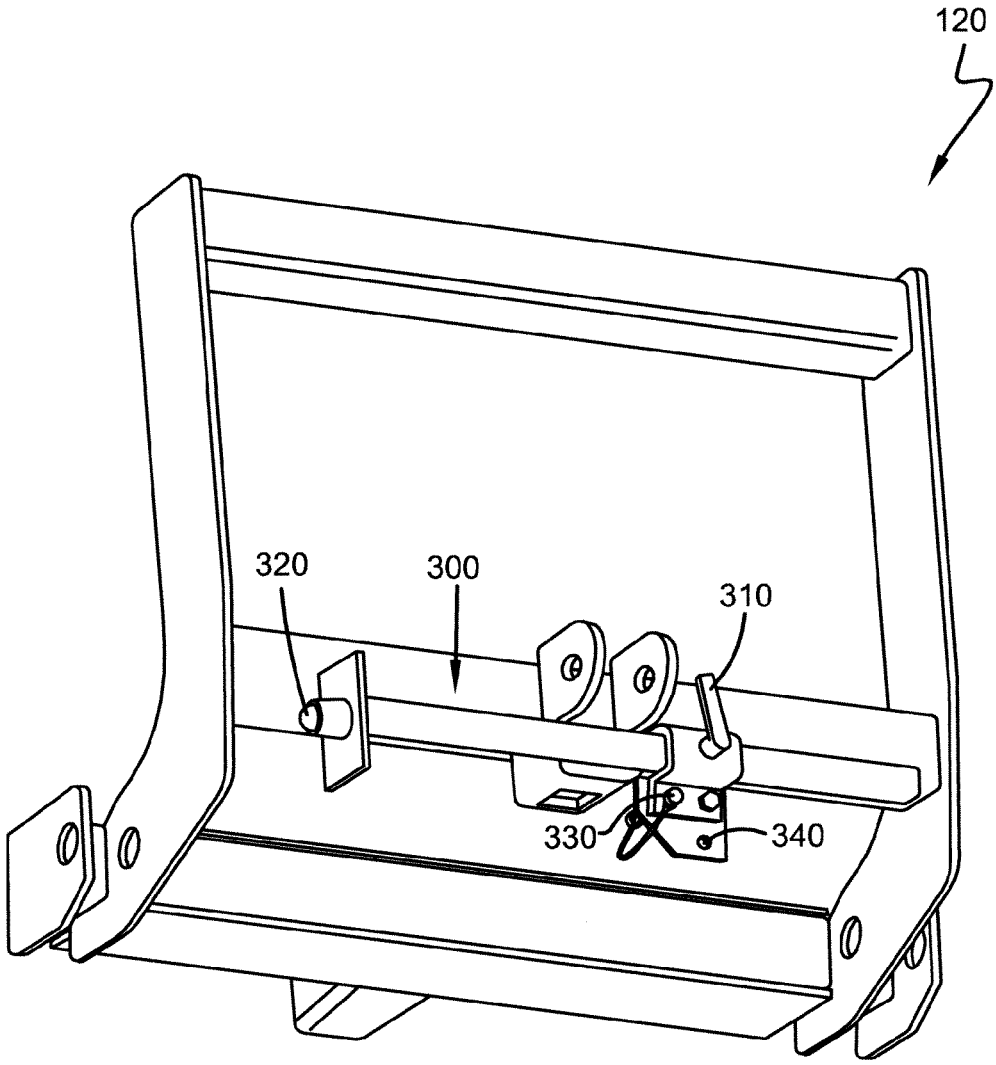
FIG. 9A is a perspective view of a jack stand shown in the storage position, according to one embodiment.
Figure 9B:
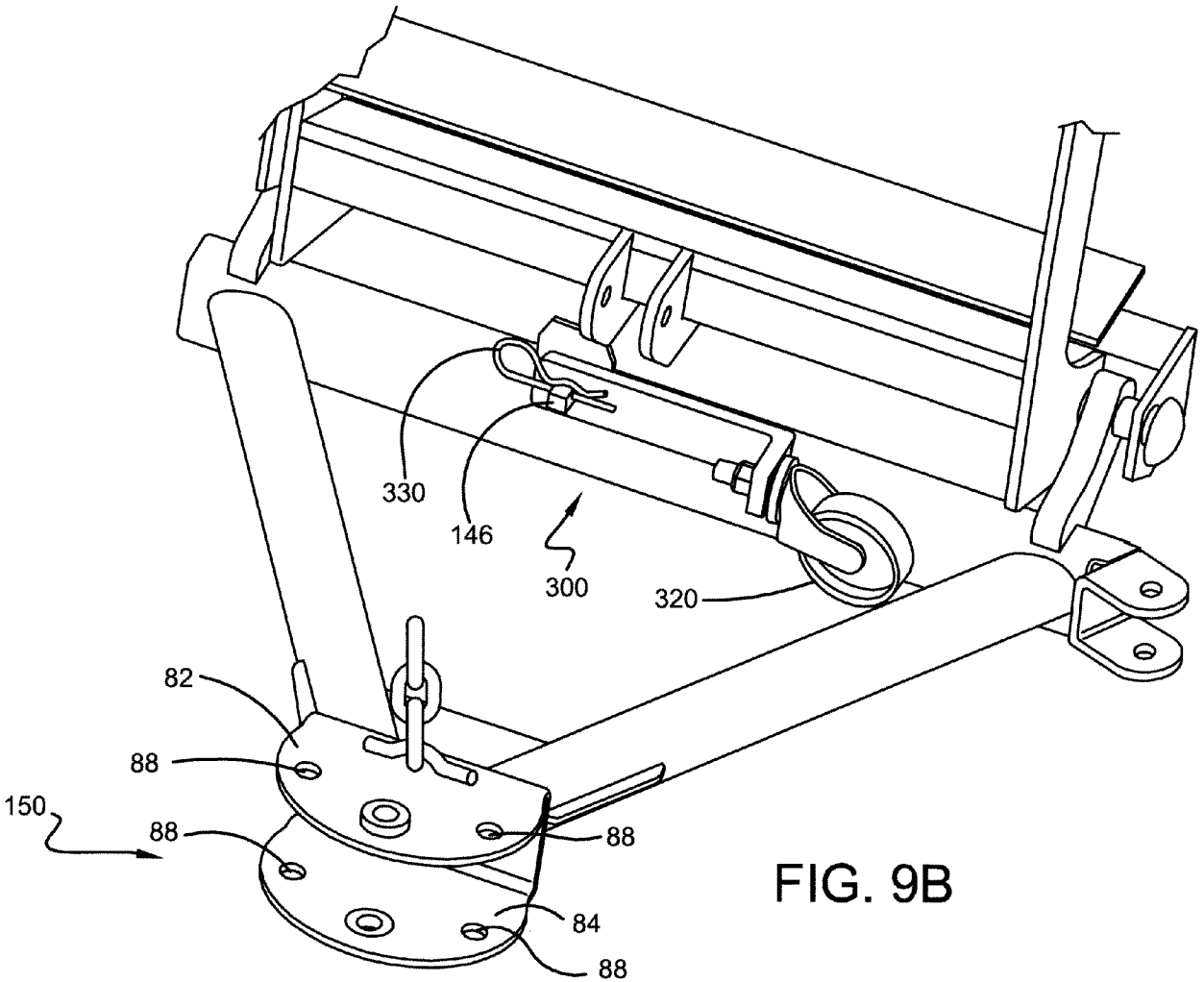
FIG. 9B is a perspective view of a jack stand shown in the storage position, according to one embodiment.
Figure 10A:
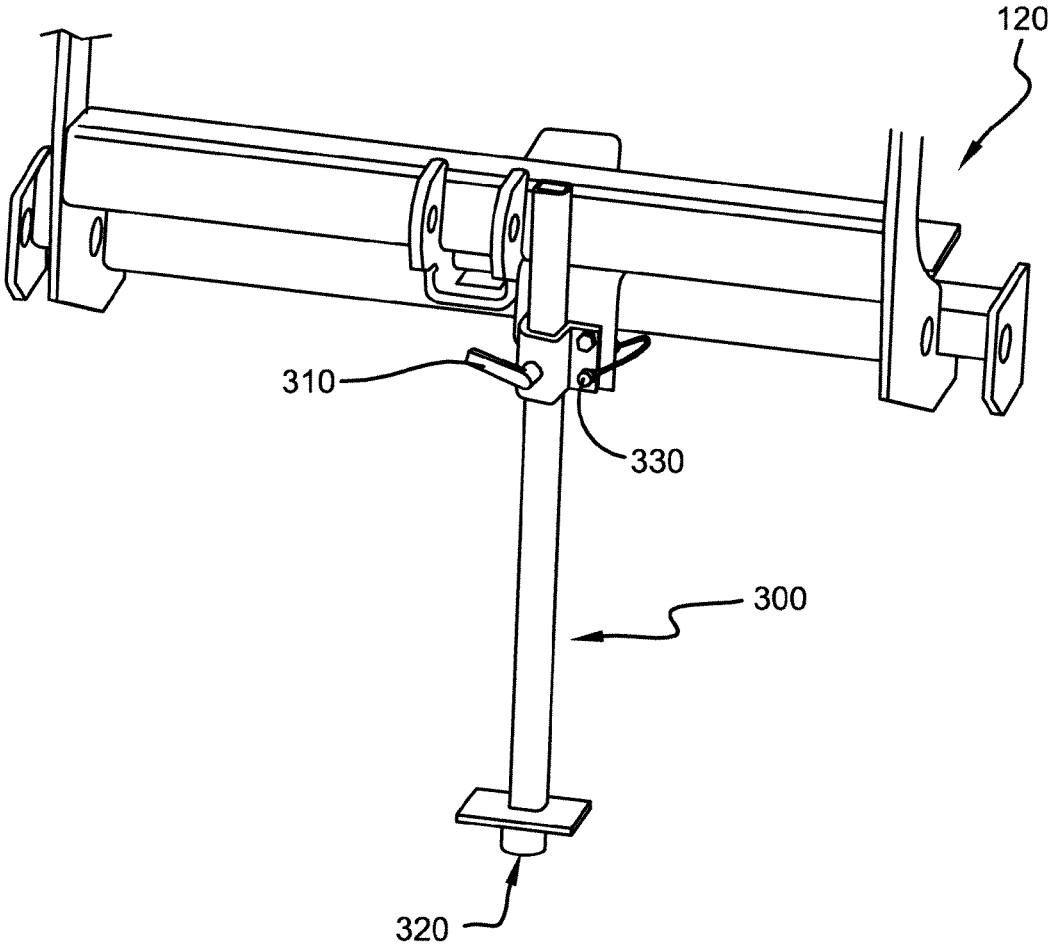
FIG. 10A is a perspective view of a jack stand shown in the use position, according to one embodiment.
Figure 10B:
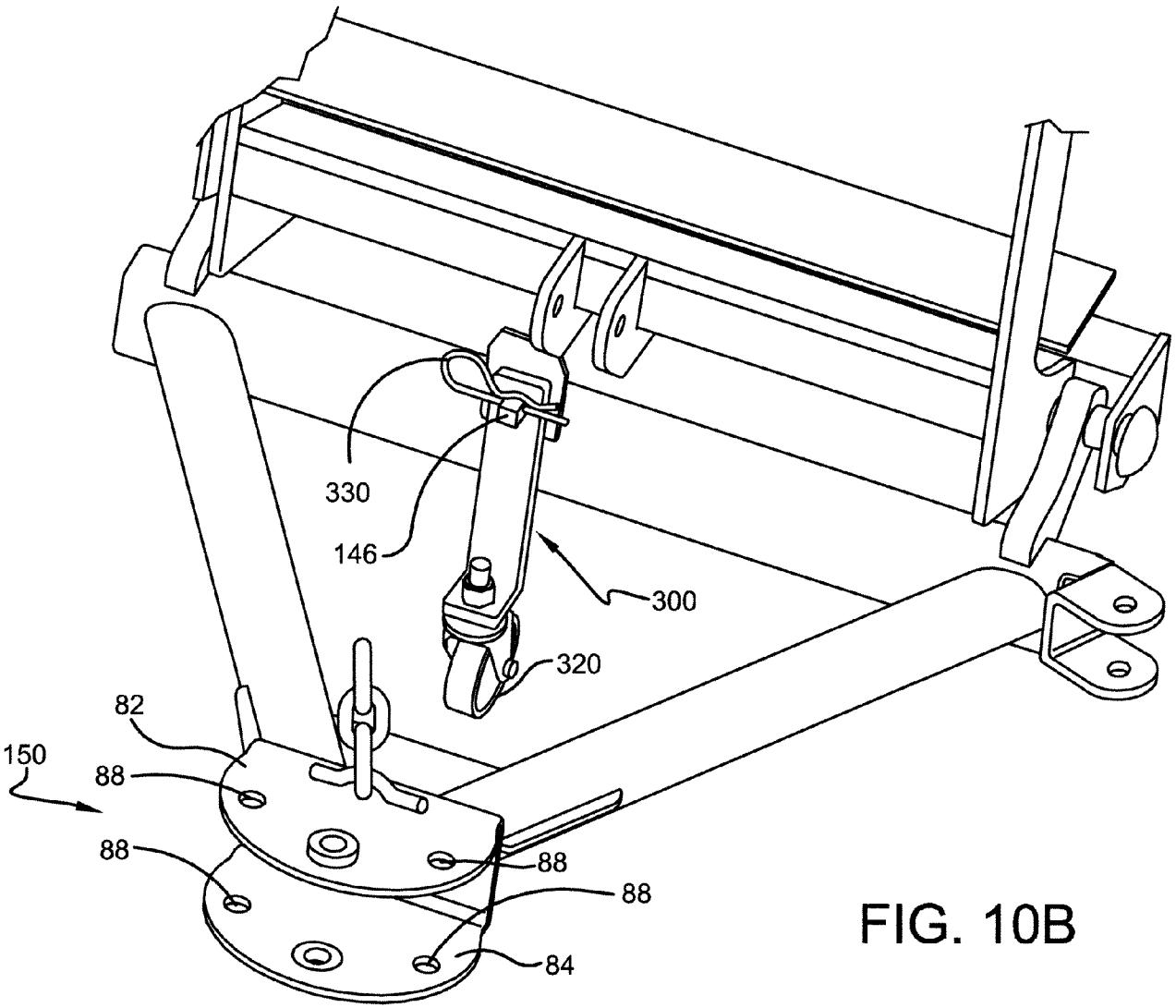
FIG. 10B is a perspective view of a jack stand shown in the use position, according to one embodiment.

With reference to FIGS. 9A, 9B, 10A, and 10B, the snowplow assembly 20 can include a jack stand 300 pivotally connected to the support assembly 120 or pivotally connected to the plow mount assembly 140 or A-frame. The jack stand 300 can support the snowplow assembly 20 when the snowplow assembly 20 is not attached to an associated vehicle. The jack stand 300 can pivot between a use position supporting the snowplow assembly, as shown in FIGS. 10A and 10B, and a storage position, as shown in FIGS. 9A and 9B. The jack stand 300 can include a height adjustment mechanism 310 to adjust the height of the jack stand 300. The height adjustment mechanism 310 can include an adjusting bolt to secure and release the jack stand 300. When the jack stand 300 is released, the height can be adjusted. The jack stand 300 can include a roller device 320 to contact a ground surface in the use position. The roller device 320 can be a roller ball, a ball bearing, a ball caster, a ball transfer or ball transfer unit, a caster, a wheel, or any other roller chosen with ordinary skill in the art. A retaining device or pin 330 can maintain the jack stand 300 in the use position or the storage position. The pin 330 can be inserted into an aperture in a plate 340 corresponding to the storage position, as shown in FIG. 9A, and the pin can be inserted into an aperture in the plate 340 corresponding to the use position, as shown in FIG. 10A. Alternatively, a retaining device or pin 330 can be inserted into an aperture 148 on a post 146 in the storage position, as shown in FIG. 9B, or in the use position, as shown in FIG. 10B. The post 146 can be positioned on the plow mount assembly 140 or A-frame. In some embodiments, the post 146 can be rectangular or square corresponding to a similarly shaped opening or aperture 302 in the jack stand 300. To move the jack stand 300 between the use and storage positions according to one embodiment, the retaining device 330 is removed from the post 146, the jack stand 300 is removed from the post 146, the jack stand 300 is turned to the appropriate position, the jack stand 300 is placed on the post 146, and the retaining device 330 is inserted into the aperture 148 on the post 146.

Figure 11B:
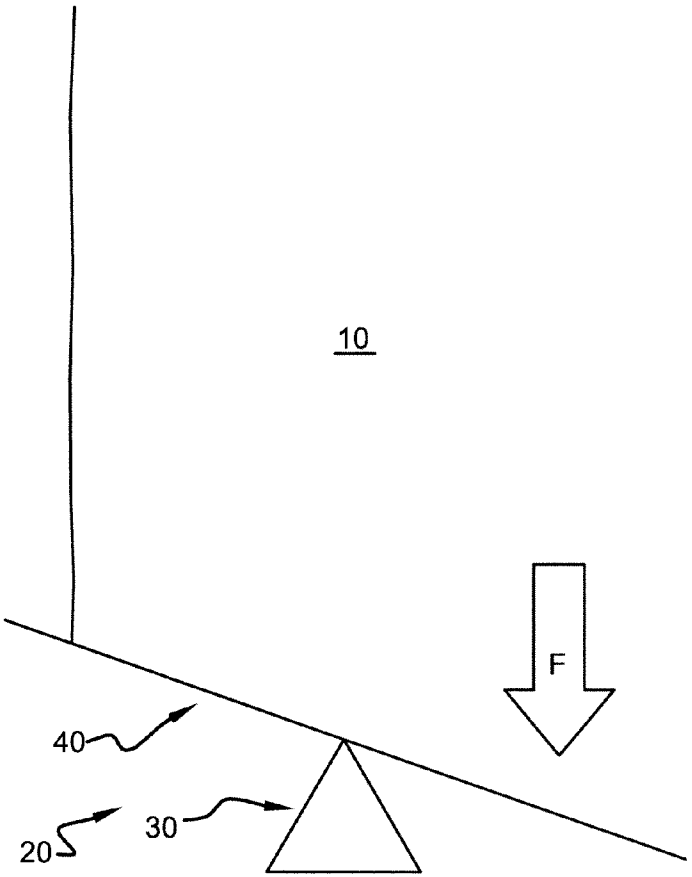
FIG. 11B is a schematic diagram illustrating the snowplow assembly in use with the snowplow in a second angled position, according to one embodiment.
Figure 11A:
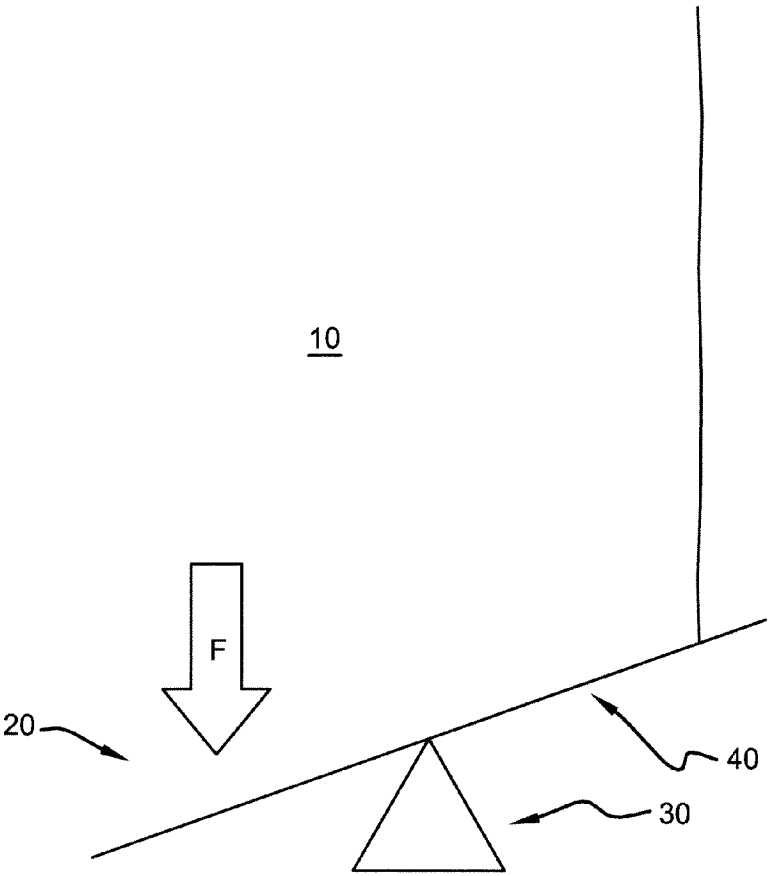
FIG. 11A is a schematic diagram illustrating the snowplow assembly in use with the snowplow in a first angled position, according to one embodiment.

With reference to FIGS. 1-11B, the operation of the snowplow assembly 20 will be discussed, according to some embodiments. When the snowplow assembly 20 engages snow 10 in an offset condition, the force F of the snow 10 overcomes the force of the cylinder 200 and the plow blade assembly 40 pivots to the right or the left. According to the operation shown in FIG. 11A, the snowplow assembly 20 engages the snow 10 in an offset approach on the left side of the plow blade assembly 40. The force F of the snow 10 exerted on the plow blade 40 causes the plow blade assembly 40 to pivot to the left. When the snowplow assembly 20 disengages from the snow 10, the cylinder 200 returns the plow blade assembly 40 to a straight or neutral position. According to the operation shown in FIG. 11B, the snowplow assembly 20 engages the snow 10 in an offset approach on the right side of the plow blade assembly 40. The force F of the snow 10 exerted on the plow blade 40 causes the plow blade assembly 40 to pivot to the right. When the snowplow assembly 20 disengages from the snow 10, the cylinder 200 returns the plow blade assembly 40 to a straight or neutral position. While the operation of the snowplow assembly 20 shown in FIGS. 11A and 11B shows the plow blade pushing the snow 10, the snowplow assembly 20 can also be used to pull the snow 10.

Figure 12:
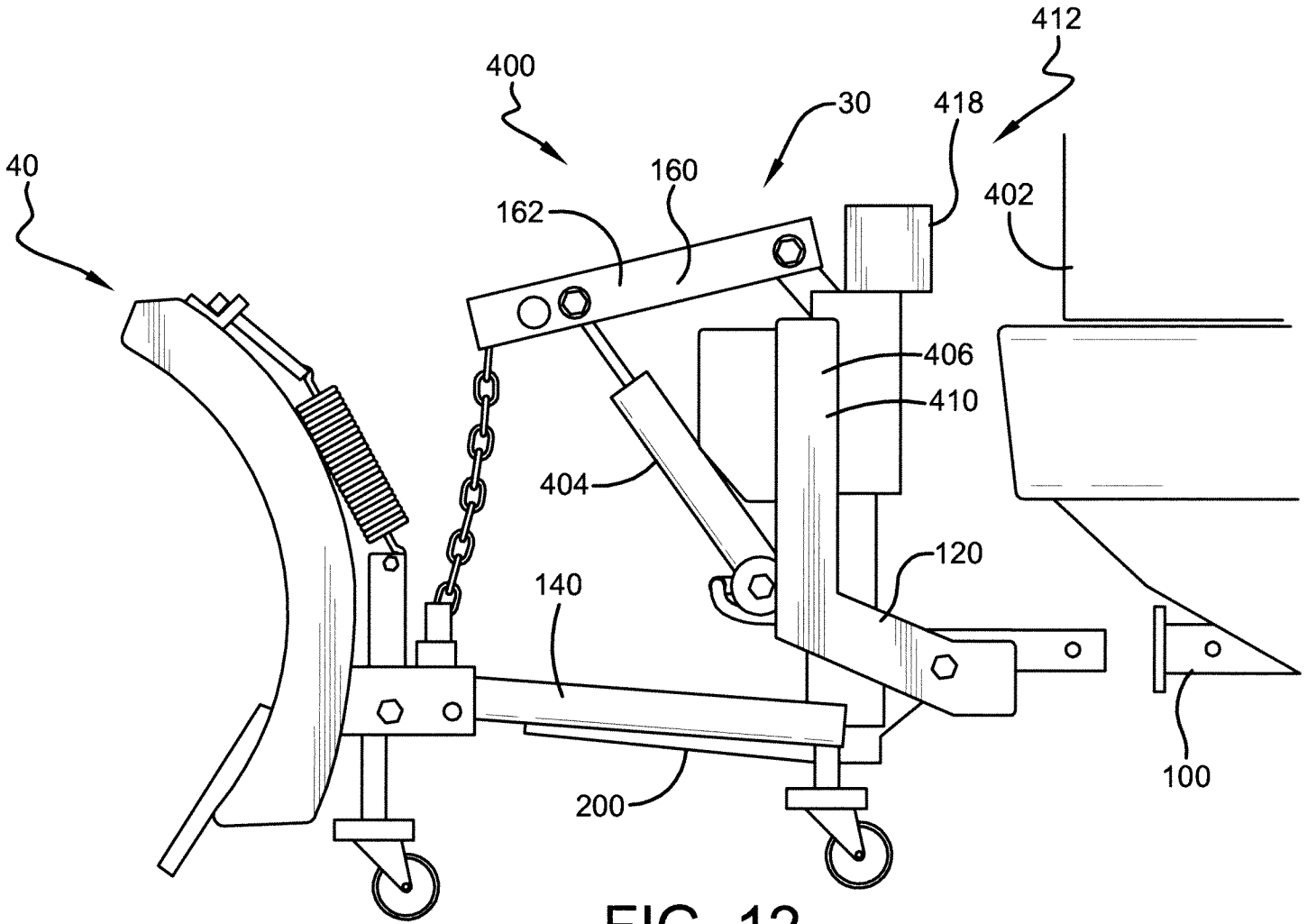
FIG. 12 is a side view of another embodiment snowplow assembly.
Figure 13:
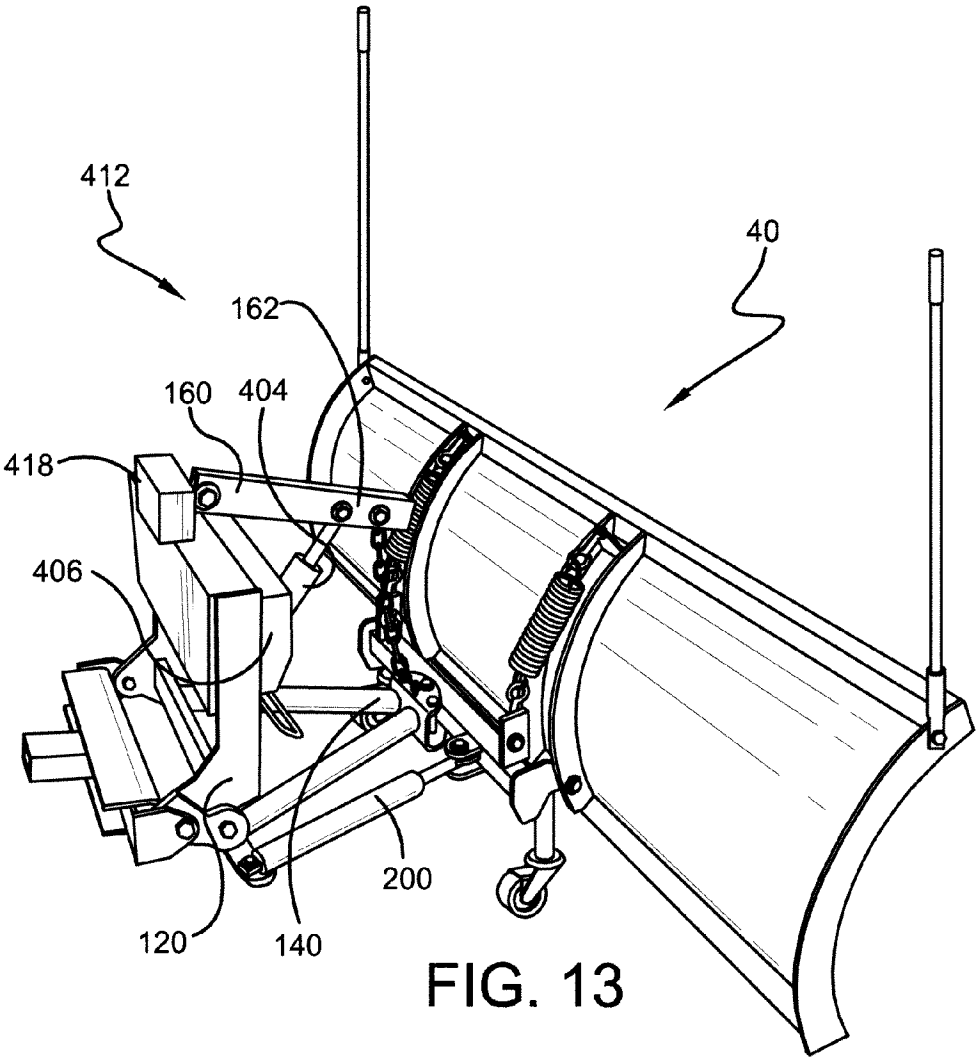
FIG. 13 is a perspective back view of the snowplow assembly shown in FIG. 12.
Figure 14:
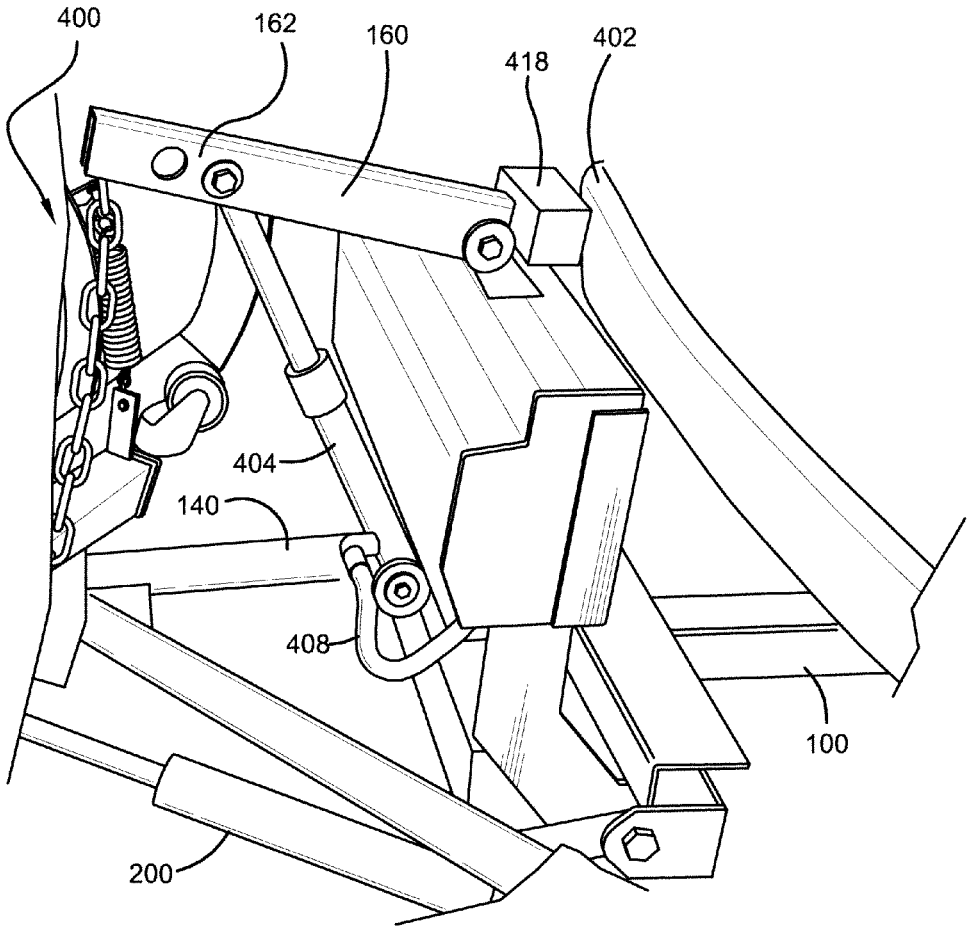
FIG. 14 is a perspective side view of a portion of the snowplow assembly shown in FIG. 12.
Figure 15:
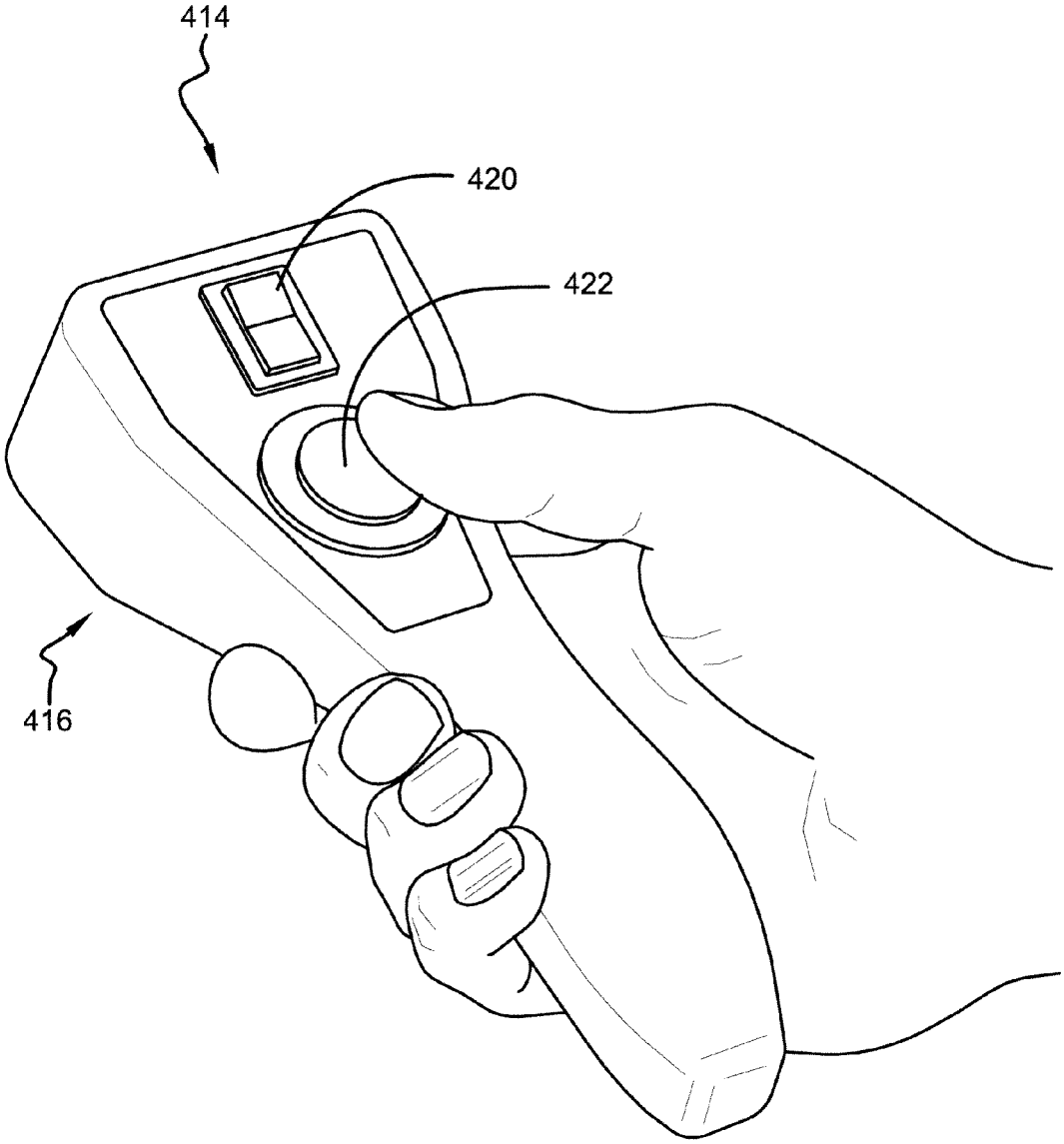
FIG. 15 is a perspective view of a controller.

With reference now to FIGS. 12-14, another embodiment snowplow assembly 400 is shown. In many ways the snowplow assembly 400 may be similar to previously described snowplow assembly 20. The snowplow assembly 400 may include a mount assembly 30 and a plow blade 40. The mount assembly 30 may include a frame mount assembly 100, which is secured to the frame members of a vehicle 402, a support assembly 120 secured to the frame mount assembly 100, a plow mount assembly 140 secured to the support assembly 120, and a lift mount assembly 160 which is also secured to the support assembly 120. The lift mount assembly 160 may include a lift bar 162 and a plow blade positioning actuator 404 for raising and lowering the plow mount assembly 140 and the plow blade 40. This will be discussed further below. The snowplow assembly 20 may also include a plow blade positioning cylinder 200 having one or more resilient members 240, 242 that enable the plow blade positioning cylinder 200 to automatically pivot the plow blade 40 from side to side without the use of a power source as discussed above. In another embodiment, not shown but similar to that shown in FIG. 4, a pair of plow blade positioning cylinders 200, 200 may be used to automatically pivot the plow blade 40 from side to side without the use of a power source.

With continuing reference to FIGS. 12-14, the plow blade positioning actuator 404 requires a power source 406 to raise and lower the plow blade 40. For the embodiment shown, the power source 406 is a hydraulic system 410 and the plow blade positioning cylinder actuator 404 is a hydraulic cylinder. At least one hydraulic conduit 408 (seen best in FIG. 14) may interconnect the hydraulic system 410 and the plow blade positioning cylinder 404. As the operation of a hydraulic system with a hydraulic cylinder is well known to those of skill in the art, further details will not be provided here. Other power sources are also contemplated such as pneumatic power sources, electric power sources and battery powered sources. In one embodiment, the power source 406 provides power both to raise and to lower the plow blade 40. In another embodiment, shown, the power source 406 provides power up and gravity down operation to the plow blade positioning cylinder 404. By "power up and gravity down" it is meant that the power source 406 provides the force to raise the plow blade 40 and that the force of gravity is used to lower the plow blade 40. For the embodiment shown, the hydraulic system 410 provides pressurized hydraulic fluid through the hydraulic conduit 408 to the plow blade positioning cylinder 404 to raise the plow blade 40. To lower the plow blade 40, the hydraulic pressure is reduced (or removed) and gravity forces the hydraulic fluid from the plow blade positioning cylinder 404, through the hydraulic conduit 408 and back to the hydraulic system 410.

With reference now to FIGS. 12-15, the snowplow assembly 400 may also include a control system 412 to operate the power source 406. In one embodiment, the control system 412 may include a controller 414 (shown in FIG. 15), a transmitter 416, and a receiver 418 that is operatively connected to the power source 406. The transmitter 416 and receiver 418 can be of any type, style and sized chosen with the sound judgment of a person of skill in the art as long as the transmitter 416 is operable to transmit a wireless control signal that is received by the receiver 418 and, in response, the receiver 418 causes the power source 406 to operate the plow blade positioning actuator 404. In one embodiment, the transmitter 416 transmits a wireless radio frequency control signal. In another embodiment, the transmitter 416 transmits an infrared control signal. If necessary, a radio frequency extender can be used to extend the operating range of the infrared transmitter. For the embodiment shown, the transmitter 416 may be positioned within the controller 414 and the receiver 418 may be positioned near to the power source 406.

Figure 16:
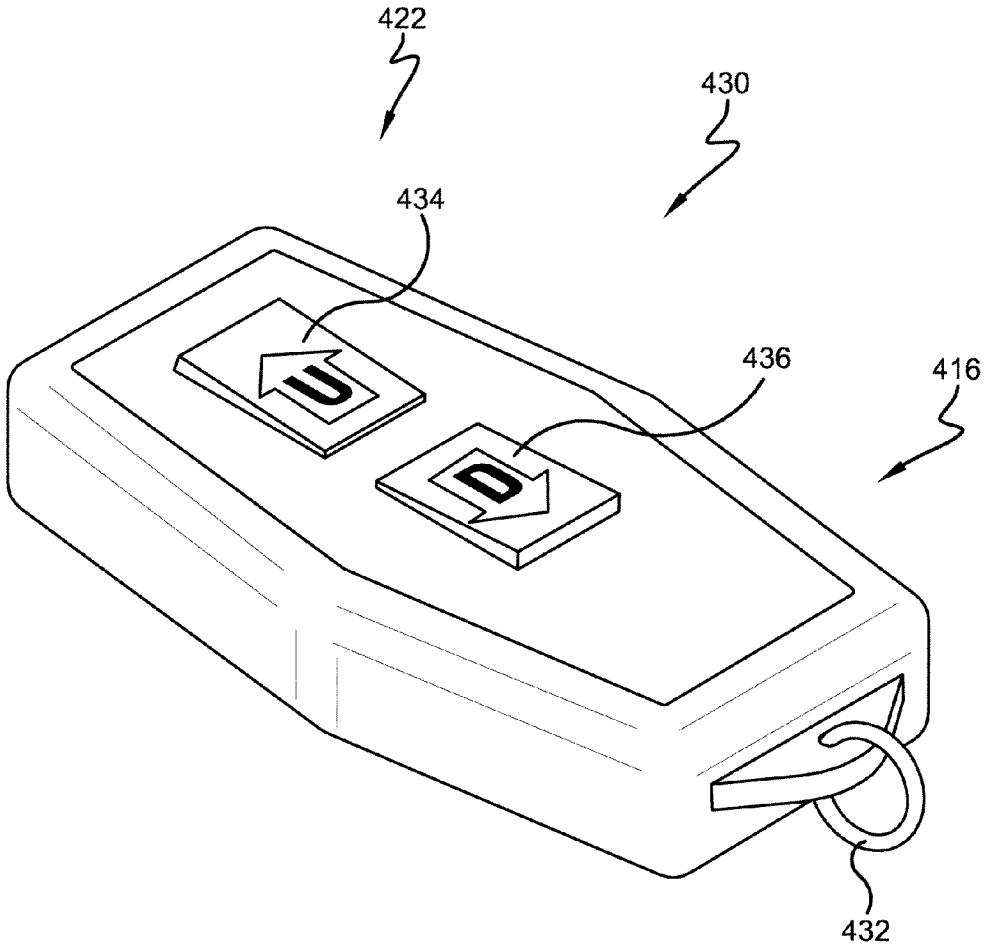
FIG. 16 is a perspective view of controller according to another embodiment.

With continuing reference to FIGS. 12-15, the controller 414 can be of any type, style and sized chosen with the sound judgment of a person of skill in the art. For the embodiment shown, the controller 414 is a remote device and may conveniently be positioned within the passenger compartment of the vehicle 402. The controller 414 may have an on/off switch 420 and an operating mechanism 422. The operating mechanism 422 may be, as shown, a button. When the operator operates the operating mechanism 422, it causes the transmitter 416 to transmit a wireless control signal that is received by the receiver 418 and, in response, the receiver 418 causes the power source 406 to operate the plow blade positioning cylinder 404 to move the plow blade 40 between a lowered plowing positioned (where the plow blade 40 can be used to plow snow) and a raised non-plowing position. FIG. 16 shows another embodiment controller 430. This controller 430 is also a remote device but it is much smaller than the controller 414. The controller 430 may fit easily, for example, into the operator's coat pocket, pants pocket, purse or the like. The transmitter 416 may be positioned within the controller 430 and the controller 430 may have an attachment ring 432 for use in attaching the controller 430 to a key chain or the like. The controller may also have an operating mechanism 422 used by the operator to transmit a wireless control signal to raise and lower the plow blade 40. For the specific embodiment shown, the operating mechanism 422 includes a first button 434 labeled "U" (representing "up") for use in raising the plow blade 40 and a second button 436 labeled "D" (representing "down") for use in lowering the plow blade 40.

Figure 17:
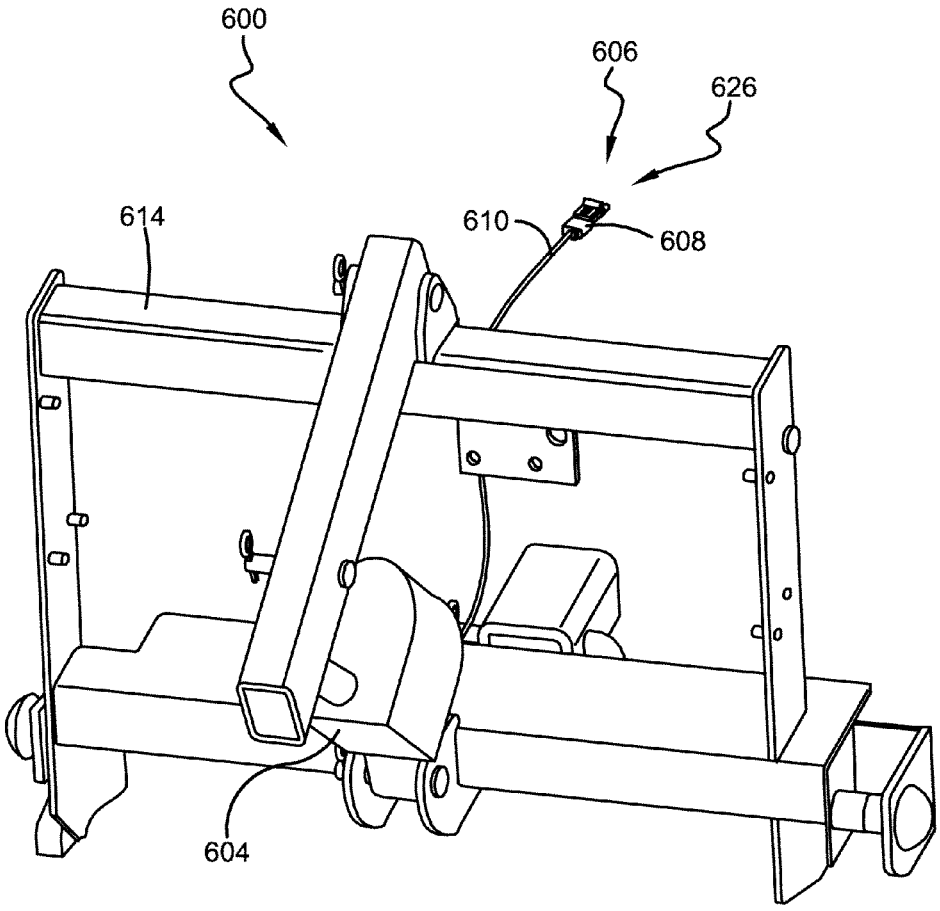
FIG. 17 is a perspective view of a portion of a snowplow assembly according to another embodiment.
Figure 18:
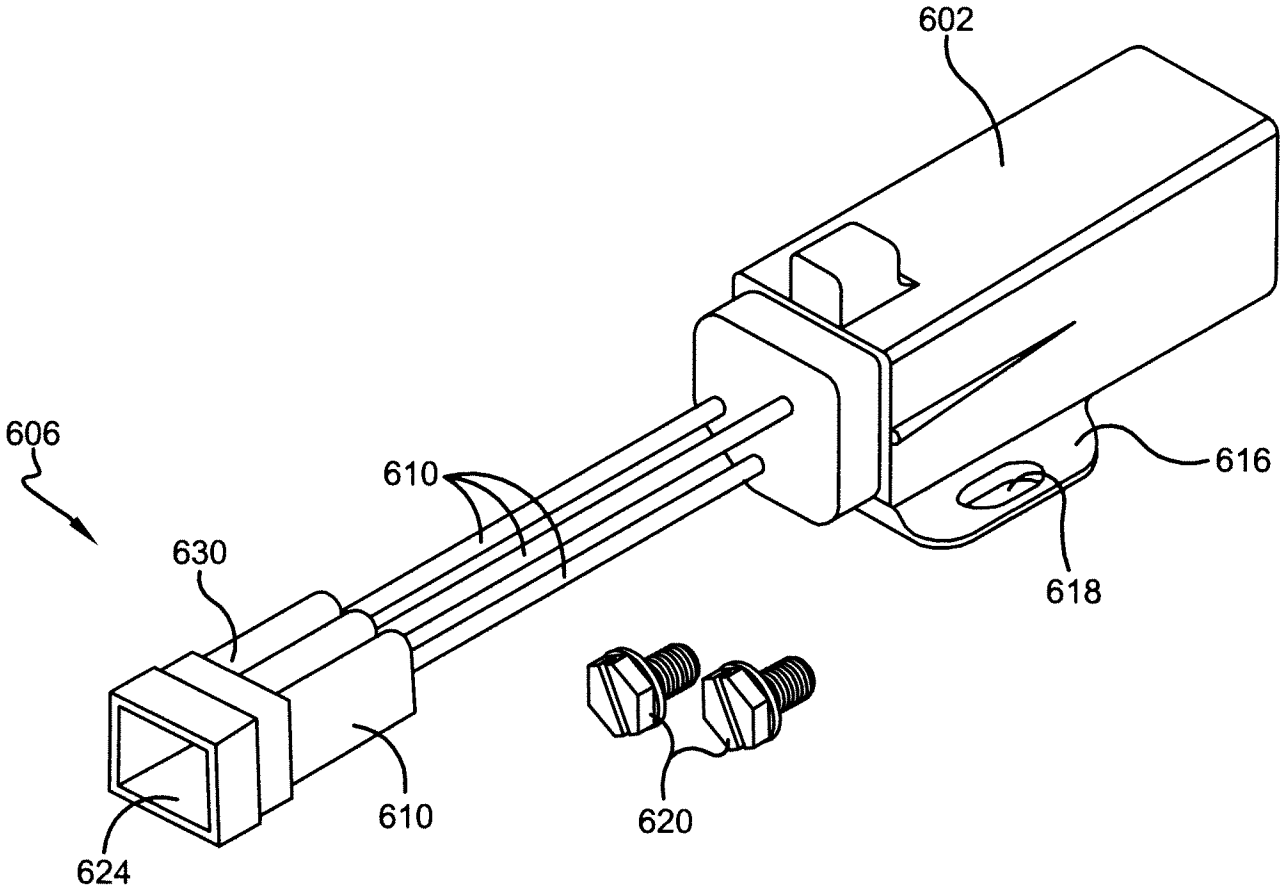
FIG. 18 illustrates a receiver having a receiver plug.
Figure 19:
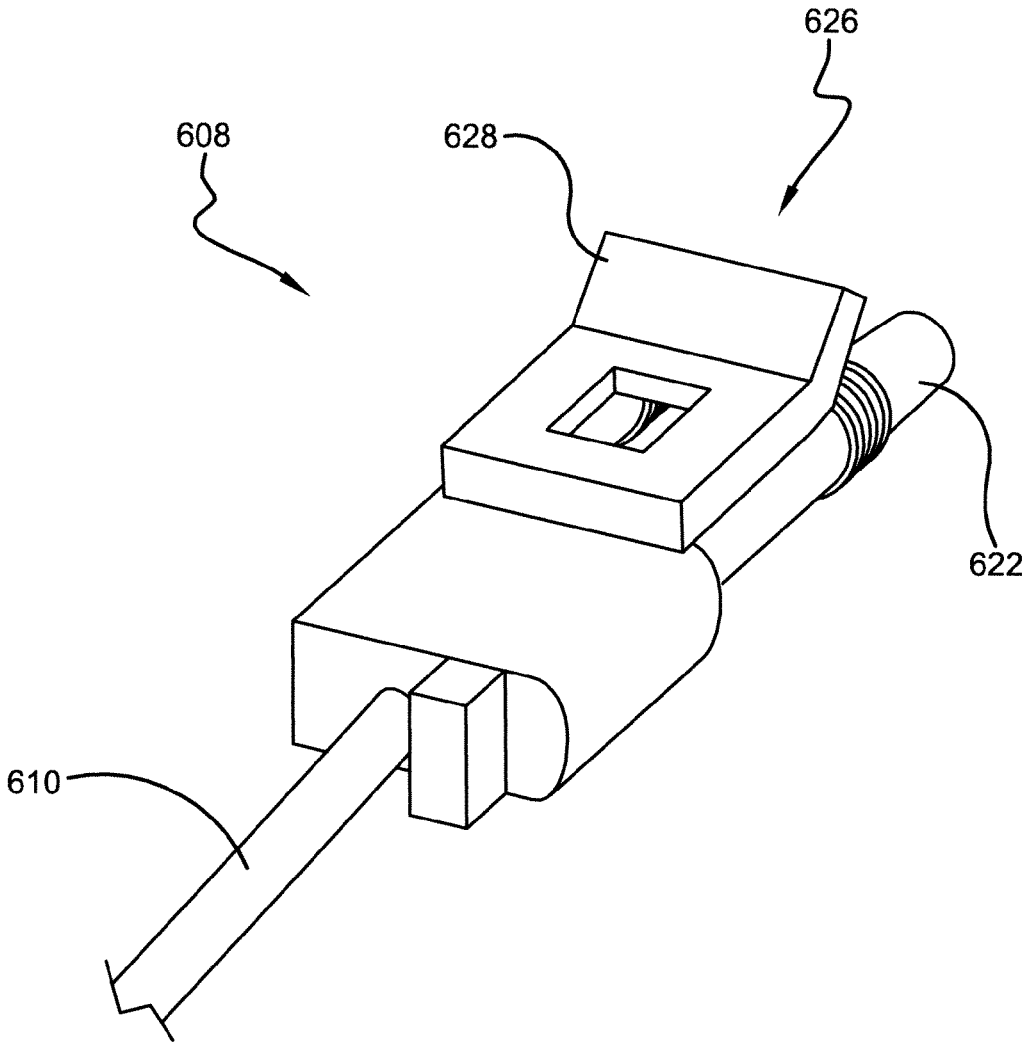
FIG. 19 is a close up view of the actuator plug shown in FIG. 17.

FIGS. 17-19 illustrate another embodiment snowplow assembly 600 that provides more flexibility and ease of installation. Between a receiver 602 and a plow blade positioning actuator 604 (used to raise and lower a plow blade—not shown) is a connection plug assembly 606. The connection plug assembly 606 may include an actuator plug 608 that is electrically connected to the actuator 604 and a receiver plug 610 that is electrically connected to the receiver 602. Flexible connectors (wires or the like) 610 may be used to connect the plugs 608, 610 to the corresponding actuator 604 and receiver 602. The receiver 602 can be attached to any convenient location of the snowplow assembly 600 chosen with the sound judgment of a person of skill in the art. In one non-limiting example, the receiver 602 may be attached to the plow mount assembly 614. For attachment purposes, the receiver 602 may have one or more mounting surfaces 616 each having one or more openings 618 through which connectors 620 can be inserted to attach the receiver 602 to the snowplow assembly 600. The plugs 608, 610 can be of any style and shape chosen with the sound judgment of a person of skill in the art. For the embodiment shown, one of the connectors (the actuator plug 608) has a male portion 622 that is received in a female portion 624 on the other connector (the receiver plug 610) to manually engage the plugs 608, 610 to complete the electrical connection between the receiver 602 and the actuator 604. A latch mechanism 626 may also be used to hold the plugs 608, 610 into electrical engagement with each other. For the latch mechanism 626 shown, a latch plate 628 extends from one of the connectors (the actuator plug 608) and is connectable to a latch plate reception surface 630 positioned on the other connector (the receiver plug 610). To disconnect the latch mechanism 626, it is only necessary to lift the latch plate 628 away from the latch plate reception surface 630.

Figure 20:
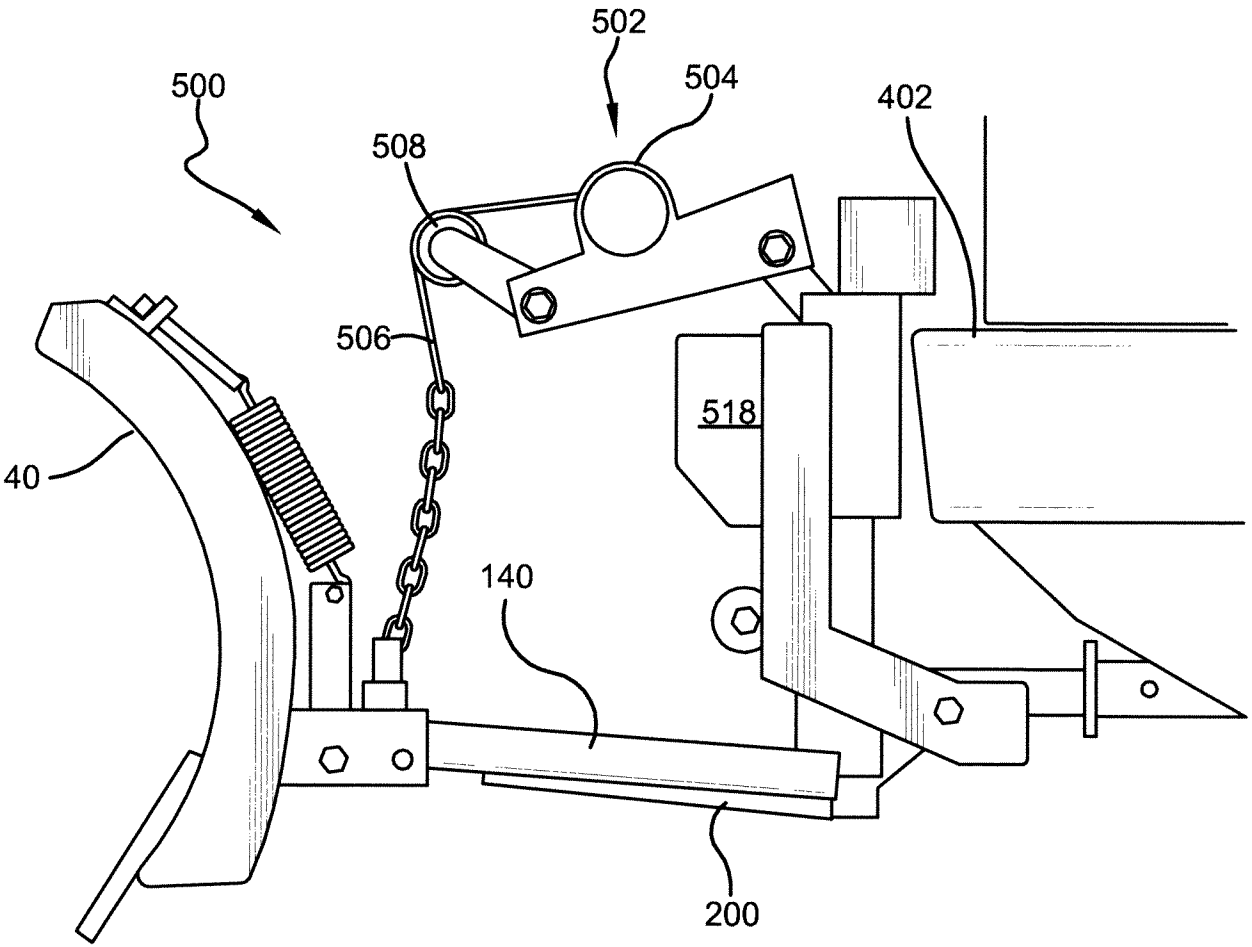
FIG. 20 is a side perspective view of another embodiment snowplow assembly.

With reference now to FIG. 20, in another embodiment snowplow assembly 500 the lift mount assembly 502 comprises a winch 504 for raising and lowering the plow mount assembly 140 and thus the plow blade 40. The winch 504 may have a lift cable 506 which may be partially wrapped around a pulley 508. The winch 504 may have a motor and the motor may be controlled by a control system similar to the previously described control system 412 including transmitter 416 and a receiving 518 that is operatively attached to the winch 504 motor. The plow blade positioning cylinder 200 (one shown but two could be used) may operate as described above.

Numerous embodiments have been described herein. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

We claim:

1. A snowplow assembly comprising:

a plow blade assembly including a plow blade with a snow engaging surface for plowing snow;

a first plow blade positioning cylinder that operates to pivot the plow blade from side to side, the first plow blade positioning cylinder comprising a first resilient member that automatically pivots the plow blade from side to side without use of a power source;

a plow blade positioning actuator that operates to raise and lower the plow blade between a lowered plowing positioned and a raised non-plowing position;

a power source operatively connected to the plow blade positioning actuator; and, a control system comprising:

a controller comprising an operating mechanism;

a transmitter;

a receiver that is operatively connected to the power source; and, wherein the operating mechanism is operable to cause the transmitter to transmit a wireless control signal that is received by the receiver and, in response, the receiver causes the power source to operate the plow blade positioning actuator to move the plow blade between the lowered plowing positioned and the raised non-plowing position.

2. The snowplow assembly of claim 1 wherein the transmitter transmits a wireless radio frequency control signal.

3. The snowplow assembly of claim 1 wherein the transmitter transmits a wireless infrared control signal.

4. The snowplow assembly of claim 1 further comprising a connection plug assembly comprising:

an actuator plug that is electrically connected to the actuator via a first flexible connector;

a receiver plug that is electrically connected to the receiver via a second flexible connector; and, wherein the actuator plug and receiver plug are manually engageable to complete the electrical connection between the receiver and the actuator.

5. The snowplow assembly of claim 1 wherein the power source provides power up and gravity down operation to the plow blade positioning actuator.

6. The snowplow assembly of claim 1 further comprising:

a second plow blade positioning cylinder that operates to pivot the plow blade from side to side, the second plow blade positioning cylinder comprising a first resilient member that automatically pivots the plow blade from side to side without use of a power source.

7. A snowplow assembly comprising:

a mount assembly operatively connected to an associated vehicle;

a plow blade assembly including a plow blade with a snow engaging surface for plowing snow, wherein the plow blade assembly is pivotally connected to the mount assembly;

a plow blade positioning cylinder that operates to pivot the plow blade from side to side, the plow blade positioning cylinder comprising a cylinder housing, a piston, a piston rod, and first and second resilient members located substantially within the cylinder housing, wherein a first end of the plow blade positioning cylinder is pivotally connected to the mount assembly and a second end of the plow blade positioning cylinder is pivotally connected to the plow blade assembly, wherein the first and second resilient members automatically pivot the plow blade from side to side without use of a power source;

a plow blade positioning actuator that operates to raise and lower the plow blade between a lowered plowing positioned and a raised non-plowing position;

a power source operatively connected to the plow blade positioning actuator; and, a control system comprising:

a controller comprising an operating mechanism;

a transmitter;

a receiver that is operatively connected to the power source; and, wherein the operating mechanism is operable to cause the transmitter to transmit a wireless control signal that is received by the receiver and, in response, the receiver causes the power source to operate the plow blade positioning actuator to move the plow blade between the lowered plowing positioned and the raised non-plowing position.

8. The snowplow assembly of claim 7 wherein:

the first resilient member compresses when the plow blade is in a first angled position; and the second resilient member compresses when the plow blade is in a second angled position.

9. The snowplow assembly of claim 8 wherein the second resilient member extends when the plow blade is in the first angled position, and wherein the first resilient member extends when the plow blade is in the second angled position.

10. The snowplow assembly of claim 7 wherein:

the first resilient member extends when the plow blade is in a first angled position; and the second resilient member extends when the plow blade is in a second angled position.

11. The snowplow assembly of claim 10 wherein the second resilient member compresses when the plow blade is in the first angled position, and wherein the first resilient member compresses when the plow blade is in the second angled position.

12. The snowplow assembly of claim 11 further comprising:

a locking device which can maintain the plow blade assembly in one of the first angled position or the second angled position.

13. The snowplow assembly of claim 7 wherein:

the plow blade is pivotal into a first angled position and a second angled position;

first and second locking devices are secured to the mount assembly;

first and second stop devices are secured to the plow blade assembly;

the first locking device is attachable to the first stop device when the plow blade is in the first angled position maintaining the plow blade in the first angled position; and the second locking device is attachable to the second stop device when the plow blade is in the second angled position maintaining the plow blade in the second angled position.

14. A method comprising the steps of:

(A) providing a snowplow assembly comprising: a plow blade assembly including a plow blade with a snow engaging surface for plowing snow; a plow blade positioning cylinder that operates to pivot the plow blade from side to side, the first plow blade positioning cylinder comprising a first resilient member; a plow blade positioning actuator that operates to raise and lower the plow blade between a lowered plowing positioned and a raised non-plowing position; and, a power source operatively connected to the plow blade positioning actuator;

(B) providing a control system comprising: a controller comprising an operating mechanism; a transmitter; and, a receiver that is operatively connected to the power source;

(C) using the first resilient member to automatically pivot the plow blade from side to side without use of any power source; and, (D) operating the operating mechanism to cause the transmitter to transmit a wireless control signal that is received by the receiver and, in response, the receiver causes the power source to operate the plow blade positioning actuator to move the plow blade between the lowered plowing positioned and the raised non-plowing position.

15. The method of claim 14 wherein step (D) comprises the step of:

using power up and gravity down operation.

16. The method of claim 14 wherein step (D) comprises the step of:

causing the transmitter to transmit a wireless radio frequency control signal.

17. The method of claim 14 wherein step (D) comprises the step of:

causing the transmitter to transmit a wireless infrared control signal.

18. The method of claim 14 wherein:

step (A) comprises the step of: providing the plow blade positioning cylinder with a second resilient member; and, step (C) comprises the steps of: compressing the first resilient member when the plow blade is in a first angled position; and, compressing the second resilient member when the plow blade is in a second angled position.

19. The method of claim 14 wherein:

step (A) comprises the step of: providing the plow blade positioning cylinder with a second resilient member; and, step (C) comprises the steps of: extending the first resilient member when the plow blade is in a first angled position; and, extending the second resilient member when the plow blade is in a second angled position.

20. The method of claim 14 wherein:

step (C) comprises the steps of: compressing the first resilient member when the plow blade is in a first angled position; and, extending the first resilient member when the plow blade is in a second angled position.

* * * * *